United States Patent [19]

Schulze

[11] Patent Number: 4,873,912

[45] Date of Patent: Oct. 17, 1989

[54] HYDRAULIC DRIVING ARRANGEMENT

[75] Inventor: Eckehart Schulze, Weissach, Fed. Rep. of Germany

[73] Assignee: Hartmann & Lammle GmbH & Co. KG, Fed. Rep. of Germany

[21] Appl. No.: 502,552

[22] Filed: Jun. 9, 1983

[30] Foreign Application Priority Data

Jun. 9, 1982 [DE] Fed. Rep. of Germany ..... 3221758

[51] Int. Cl.[4] ..... F15B 13/16

[52] U.S. Cl. ..... 91/389; 91/277; 91/524

[58] Field of Search ..... 91/165, 519, 277, 361, 91/389, 459, 524; 137/901, 539, 539.5; 251/63.4

[56] References Cited

U.S. PATENT DOCUMENTS

| | | | |
|---|---|---|---|
| 1,508,635 | 9/1924 | Woodham | 137/901 |
| 2,182,659 | 12/1939 | Cook | 91/165 |
| 2,200,998 | 5/1940 | Schnuck | 91/519 |
| 2,244,420 | 6/1941 | Dinzl | 91/519 |
| 2,324,697 | 7/1943 | Harrington et al. | 91/519 |
| 2,502,547 | 4/1950 | Adams et al. | 91/519 |
| 2,513,888 | 7/1950 | Newell | 91/165 |
| 2,519,900 | 8/1950 | Geiger | 91/165 |
| 2,555,115 | 5/1951 | Cizek | 91/519 |
| 2,633,708 | 4/1953 | Sedgwick | 91/519 |
| 2,891,517 | 6/1959 | Towler et al. | 91/519 |
| 3,104,591 | 9/1963 | Codnohufsky | 91/519 |
| 3,318,196 | 5/1967 | Cox et al. | 91/519 |
| 3,410,089 | 11/1968 | Snitgen | 91/519 |
| 3,662,651 | 5/1972 | Cunningham | 91/165 |
| 4,151,861 | 5/1979 | Bohrdt | 137/901 |

*Primary Examiner*—Robert E. Garrett
*Assistant Examiner*—Thomas Denion
*Attorney, Agent, or Firm*—Antonelli, Terry & Wands

[57] ABSTRACT

A hydraulic drive system for a machine element performing in one work cycle a sequence of motions comprising a rapid feed motion, a working stroke under load and an oppositely directed rapid-return motion. The drive element includes a hydraulic cylinder having three working surfaces $A_1$, $A_2$, $A_3$. Motion control is effected by an electro-hydraulic follow-up control valve with a pre-setting device controlled by a stepping motor and a mechanical actual-value feed-back device. During rapid feed motion, the relatively small working surface $A_1$ is subjected to the output pressure of the follow-up control valve only, while during the working stroke the pressure acts additionally on the working surface $A_3$. The rapid-return movements of the piston of the cylinder are controlled by applying pressure to the working surface $A_2$, or by relieving pressure from the two other working surfaces $A_1$ and $A_3$. A pressure-controlled reversing valve is moved by the output pressure of a pilot valve control arrangement into its operating position corresponding to the working stroke when the output pressure $P_A$ of the follow-up control valve exceeds a pre-determined threshold value $P_{sl}$, and returned to its operating position corresponding to the rapid motion conditions when the output pressure $P_A$ of the follow-up control valve has dropped to a value $P_{s2}$ below or at least equal to the value $P_{s1}.A_1/A_L$, wherein in the particular case described $L_L=(A_1+A_3)$.

25 Claims, 7 Drawing Sheets

HYDRAULIC DRIVING ARRANGEMENT

BACKGROUND OF THE INVENTION

The present invention relates to a hydraulic driving arrangement for a machine element intended for processing a workpiece and performing to this end an operating cycle composed of a rapid feed motion directed towards the workpiece, followed by a working stroke effected in the same direction and serving to process the workpiece, and finally an oppositely directed rapid return motion, with a hydraulic cylinder serving as driving element and comprising at least three working surface A1, A2 and A3 defining each one delimiting face of a first, a second and a third pressure chamber, the rapid feed motion and the rapid return motion of the piston of the hydraulic cylinder for the machine element being controllable by alternate admission and release of pressure to and from the first and the second pressure chambers of the hydraulic cylinder, while the feeding power can be increased, if this should become necessary for performing the working stroke, by admitting pressure to the third pressure chamber of the hydraulic cylinder delimited by the said third working surface A3.

Hydraulic driving arrangements of this type have been generally known, for instance in connection with punching machines, in which the punching tool mounted on the piston of the hydraulic drive cylinder approaches the workpiece as closely as possible at rapid speed and relatively low feeding force, then penetrates and cuts the workpiece at increased feeding force, ejects the piece of material cut out in the further course of its working stroke through the punched opening, and finally returns to its initial position at rapid speed.

The following points are, however, problematic in these arrangements:

1. The exact change-over from the rapid feed to working stroke, i.e. the change-over from low to high feeding power, which is achieved by alternate or additional admission of pressure to the third pressure chamber of the hydraulic cylinder delimited by the large piston surface A3; and
2. the reversal of the direction of movement of the tool which is achieved by alternating the admission of pressure between the first and the second pressure chambers of the hydraulic cylinder.

If the change-over from rapid feed to working stroke is effected as a function of the length of travel, for instance by means of suitable approximation switches responding to specific instantaneous positions of the piston of the hydraulic cylinder, whose output signals actuate control valves taking the form of solenoid valves, a change-over from rapid feed to working stroke will be effected in each operating cycle, regardless of whether or not it is actually required, so that relatively long cycle times must be accepted which imposes considerable and often unnecessary limitations upon the working speed of a punching machine which is expected to perform as many working cycles per minute as possible.

This disadvantage is aggravated by the fact that solenoid valves that can be electrically actuated require switching times in the range of approx. 20 to 25 ms, which again contributes to extending the cycle times. The same disadvantage must be accepted in cases where the change-over from rapid feed to working stroke is effected in response to the pressure and, thus, in a manner more likely to meet the practical requirements, if the means used for effecting the change-over consist in electromagnetic push-button switches which respond to the pressure supplied to the pressure chamber of the hydraulic driving cylinder in the rapid motion and whose electric output signals actuate solenoid valves to supply the appropriate pressures to the pressure chambers of the hydraulic drive cylinders.

As regards the reversal of motion of the piston of the drive cylinder controlled in this manner it is further a considerable disadvantage that the reversal of the direction of action of the forces acting upon the piston occurs necessarily in a sudden manner which results in vibrations which cause not only increased wear, but also heavy operating noises.

Although it is certainly possible to give the hydraulic drive cylinder and the machine equipped therewith a stability sufficient to achieve the minimum service life deemed necessary, and to equip the hydraulic drive cylinder with additional hydromechanical and/or resilient damping elements in order to reduce the vibrations which would otherwise be encountered at the dead centers of its advance and return movements, so as to avoid excessive noise, the technical input required for this purpose is quite considerable and leads finally again to increased cycle times and also to the necessity to increase the installed drive power.

Now, it is the object of the invention to provide a hydraulic drive system of the type described above, which makes it possible, on the one hand, to obtain clearly reduced cycle times for a machine equipped with this device and ensures, on the other hand, that the driven machine element enters and/or passes through, its different dead center positions or end positions during any working cycle smoothly and without causing excessive vibrations.

According to advantageous features of the present invention, a hydraulic driving arrangement for a machine element intended for processing a workpiece and performing an operating cycle composed of a rapid feed motion directed towards the workpiece, followed by a working stroke effected in the same direction and serving to process the workpiece, and finally oppositely directed rapid return motion is characterized in that, for motion control of the machine element with respect to direction and lift, a hydraulic control circuit is provided, with the hydraulic control circuit comprising a hydro-mechanical actual-value, fee-back device adapted to be supplied with presetting signals characteristic of at least end positions of the machine element for presetting the desired values. The hydraulic control circuit effects an alternative supply of pressure to first and second pressure chambers and, if necessary, the supply of pressure to a third pressure chamber. For changing over the hydraulic cylinder from rapid feed motion to the working stroke, a reversing valve with a hydraulic pilot valve is provided which, in a first flow position corresponding to the rapid-feed motions, connects the third pressure chamber of the hydraulic cylinder with a tank of a pressure supply source. In a second flow position, connects the same pressure chamber with an A pressure outlet of a final control element of the control circuit. For controlling the reversing valve, a pilot control valve arrangement is provided which responds to output pressure $P_A$ of the hydraulic control circuit and which moves a reversing valve into a second flow position when the output pressure $P_A$ exceeds a pre-determined threshold value $P_{s1}$, and returns the reversing valve into the first flow position when the output pressure $P_A$ of the control circuit has dropped to a value $P_{s2}$ corresponding maximally to a value $P_{s1} \cdot Al/A_L$, for in: $A_1$ is a size of a surface of a piston upon which the output pressure $P_A$ of the hydraulic control circuit acts during rapid feed motion of the hydraulic cylinder, and $A_L$ is a size of a overall surface of a piston upon which the controller output pressure $P_A$ acts during the working stroke of the hydraulic cylinder.

In this arrangement, motion control is effected by a control circuit which ensures that the piston surface and/or the pressure chambers utilized for developing the needed power are at any time, i.e. during both the advance and the return movements of the hydraulic cylinder, supplied with the pressure required and that, when the piston approaches its end position determined by the given set value, the pressure in the said pressure chambers is reduced so that the piston enters its end positions smoothly and without causing undue vibrations. As a result thereof, the control circuit which uses a mechanical nominal-value feedback device, has a favorable high control frequency so that an effective control of the pressures, in the meaning of a steady decrease of the moving speed of the piston of the hydraulic cylinder towards its end positions, is ensured even in the case of relatively short cycle times. In order to make the best possible use of the favourably high control frequency of this mechano-hydraulic control circuit, the supply of pressure to, and release of pressure from the second pressure arm, through which the feeding power can be increased of reduced as needed, is controlled by means of a reversing valve with hydraulic pilot valve and short switching times in the first flow position of which i.e. in the position associated with the rapid feed motion, the further pressure chamber communicates with the tank, while in its second flow position, i.e., in the position associated with the working stroke, the further pressure chamber of the hydraulic drive cylinder communicates with the pressure outlet of the control circuit so that the pressures of all pressure chambers to which pressures are supplied with a view to developing the feeding power are subjected to the pressure control also during the working stroke which means that the motion remains as vibration-free as possible even when the piston of the hydraulic drive cylinder enters any of its end position under load. In order to enable the reversing valve itself to be moved with sufficient rapidity from its first to its second flow position, and vice versa, a pilot valve arrangement is provided which is hydraulically operated and which thus also offers favourably short switching times. The said pilot valve causes the reversing valve to return automatically to its second flow position when the output pressure of the control circuit exceeds a pre-determined threshold value $p_{s1}$, and to re-assume its first flow position as soon as the output pressure of the control value has dropped to a value $p_{s2}$ not greater than the value $p_{s1} \cdot A_1/A_L$, wherein $A_1$ is the size of the surface upon which the output pressure $P_A$ of the control circuit acts in the rapid feed motion of the hydraulic cylinder, and $A_L$ is the size of the full surface of the piston upon which the output pressure of the control circuit acts in load operation of the hydraulic cylinder. This ensures that pressure is supplied to the further pressure chamber only as and when an increased feeding power is required, whereas otherwise the rapid-motion conditions of the piston are utilized as far as possible to achieve optimally short cycle times. This also minimizes the total energy requirements of the drive so that the device of the invention requires only a relatively low installed drive power, at least on the condition that an accumulator pumping system is used for supplying the required pressure.

Advantageously, the lower pressure threshold value $p_{s2}$ at which the drive system of the invention is switched over from working stroke to rapid motion, may be lower by a defined amount than the value $p_{s1}$ $A_1/A_L$, so that when switching over from the rapid motion to working stroke the initial reduction of the output pressure $P_A$ of the control circuit does not immediately switch the system back to rapid motion when for instance the feeding power required in load operation is only little greater than the feeding power developed during the rapid motion when the pressure acts only on the working surface $A_1$. Such a design ensures a largely uniform motion sequence also in cases where a relatively small increase of the feeding power is required only for the working stroke.

To achieve an advantageously simple construction of a pilot valve arrangement suited for achieving a desirably quick reversal of the reversing valve, in accordance with the functional requirements, according to the invention, an output stage of a pilot control valve arrangement is formed by a 3/2 directional valve constructed as a pressure-control sliding valve with a first and second control pressure chamber. When the pressure level in the two control pressure chambers is substantially equal, a piston of the 3/2 directional valve is held by a bias of a restoring spring in a first upwarding position corresponding to a neutral position in which a high level pressure signal is applied to its output which retains a reversing valve in a first flow position corresponding to the rapid feed motions of the hydraulic cylinder, while when the pressure prevailing in the first control pressure chamber is higher than that prevailing in the second pressure chamber, it is moved into a second upwarding position in which the control pressure chamber of the reversing valve is pressure-relieved or connected with the tank of the pressure source so that the reversing valve is moved into a flow position associated with the working stroke. The first control pressure chamber of the 3/2 directional valve is directly connected with A pressure outlet of the control circuit and the second control pressure chamber of the 3/2 directional valve is connected with the A pressure outlet of the control circuit through a flow resistance. An over-center device responds to the output pressure $P_A$ of the control circuit and is constructed as a proportioning pressure regulator provided which, when the output pressure $P_A$ exceeds the first threshold value $P_{s1}$ connects the second control pressure chamber of the valve with the tank and, when the output pressure $P_A$ of the control circuit drops below a lower pressure value $P_{s2}$, cuts off this connection between the control pressure chamber and the tank of the supply pressure source.

Arrangements comprising a 3/3 directional valve as an output stage, and an over-center device taking the form of a proportioning pressure regulator and employed as a pilot valve for the 3/2 directional valve is extremely advantageous. The features of this valve, which preferably is constructed as a seat valve, and its functional connection to a pilot valve such as contemplated by the present invention is extremely advantageous. More particularly, in a hydraulic drive system of the present invention, the lower threshold value $P_{s1}$ at which the pilot control valve arrangement moves into the first upwarding position corresponding to the first flow position of a reversing valve may be defined by the formula:

$$P_{s2}=P_{s1}(A_1/A_L)\cdot q),$$

wherein:

$0.95>q>0.8$.

In accordance with further features of the present invention, a bias of a pressure spring provided for urging the loaded valve body of the valve seat into a closed position may be adjustable. The bias of the pressure spring urging the valve body of the seat valve of the over-center device into its closed position can be adjusted which makes it easy to pre-determine the threshold value $P_{s1}$ at which the drive system is to switch over automatically from rapid motion to load operation.

According to the present invention, a seat valve may be provided which includes a ball valve having a ball of a diameter smaller than a diameter of a housing bore in which the ball is arranged to move in an axial direction. A pressure piston is slidable guided in the housing and urged against the ball by a pressure spring bearing against the ball by a conical centering face. This arrangement of an over-center device favorably guarantees favorable short response times of the over-center device and/or the pilot valve arrangement.

In accordance with the further features of the present invention, the reversing valve is constructed as a 3/2 directional sliding valve which is shifted into a first flow position by a high-level output pressure of the pilot control valve against a restoring force of a pressure spring and moved into a second flow position by a restoring force of a pressure spring at a low output pressure level. An output pressure chamber of the reversing valve, which remains the same in all operating positions of the latter in which communicates through a flow path of low flow resistance with the third pressure chamber of the hydraulic cylinder is, in the first flow position of the reversing valve connected with the tank of the tank of the pressure source through a flow path of likewise low flow resistance. In the second flow position of the reversing valve in which the first mentioned flow path is blocked by the fact that a sealing edge of the valve body bears against a conical valve seat of a valve housing, is connected with the A pressure outlet of the hydraulic control circuit by a control channel in a valve housing which is opened in this position of the valve body. This general structure of a reversing valve is suited for the purposes of the drive system of the invention which in certain preferred embodiments of its different flow positions.

According to the present invention, the valve housing of the reversing valve includes a valve bore constructed as a step bore having a narrower step communicating within the conical valve seat with the third pressure chamber of the hydraulic cylinder and a larger bore step comprising a control channel communicating with the pressure outlet of the hydraulic control circuit. The valve body of the reversing valve is constructed as a substantially tubular body slidable guided, in a pressure-type relationship, in the valve bore by contact of an outer surface thereof with a wall of the narrower step of the bore and contact of an outwardly projecting flange with the wall of the larger step of the valve bore. The flange in annular face between the two bore steps delimit the control pressure chamber the reversing valve in an axial direction, and the flange acts to shut off the control channel against the output pressure chamber in the first flow position of the reversing and to open the connection between the control channel and the output pressure chamber of the reversing valve in the second flow position.

A large-volume annular space forming a part of the tank of the pressure supply source, according to the present invention, is arranged in the housing of the reversing valve in a coaxial arrangement with the valve body, with the annular space being adapted to be connected with the output pressure chamber of the reversing valve through large radially extending overflow channels which open into the narrower bore step and which are open in the first flow position of the reversing valve and closed in the second flow position by the valve body.

To provide for favorably low resistance and simply construction as well as to realize a compact unit incorporating the hydraulic drive cylinder, according to the present invention, the reversing valve forms an axial extension of the hydraulic cylinder, a housing of the hydraulic cylinder and valve housing of the reversing valve formed one single constructional unit.

Advantageously, according to the present invention, an output stage of the hydraulic control circuit includes a conventional mechano-hydraulic follow-up control valve including a 4/3 directional valve with a pre-setting arrangement including a spindle drive and an actual-value back-fitting device, with presetting being effected by rotary movements of a spindle nut by rotary angles $\zeta_V$ and $\zeta_R$ correlated, with respect to amount and direction, and with feed and return travel of a piston of the hydraulic cylinder and back-feed of different actual piston positions be effected by a mechanical back-feeding device which causes a spindle of the spindle drive to perform rotary movements correlated, with respect to mount and direction, with the feed and return movements of the position of the hydraulic cylinder.

By virtue of the last noted features, a follow-up control valve of generally conventional construction is particularly suited for use as an output stage of the control circuit controlling the motions of the hydraulic cylinder. The valve is suited for both digital and analog pre-setting of the desired motion sequences and strokes.

For presetting the feed and return motions of the piston of the hydraulic cylinder, according to the present invention, a stepping motor capable of being controlled in a start-stop operation is provided which can operate at a control pulse frequency of being twenty to one-hundred times greater than a number of stepping control pulses required within a period of time of a work cycle for achieving a sufficiently exact motion control.

These last noted features define a construction of the pre-setting device of the control circuit suited for providing a stored or programmable control for the operating cycles, which opens up the most diverse applications for the drive system of the invention. In this arrangement, motion can be controlled either by the preset value leading, by one or just a few setting steps, the actual value of the instantaneous position of the piston as registered by the feedback device, or simply by a preset value corresponding to the overall stroke in the feed or return direction being given at the beginning of the feed movement or the return movement phase of the piston within a period of time that is small compared with the duration of these movement phases; the latter of these two types of motion control allows particularly short work cycle times to be achieved.

The general lay-out of a pre-setting device especially designed for this manner of pre-setting the end position, which insofar can be regarded a viable alternative. A considerably simpler design construction is realized with the provision of an electro-hydraulic presetting mechanism within the hydraulic control circuit for a motion control of the piston of the hydraulic cylinder, with the electro-hydraulic presetting effecting presetting of the desired end position values determining the feed and return motions of the piston of the hydraulic cylinder by causing a double-acting control cylinder in a cycle-relating manner to move its piston into alternative end positions associated with defined rotary positions of the spindle nut of the follow-up control valve.

Advantageously, according to the present invention, for controlling the control cylinder of the pre-setting mechanism, a 4/3 directional solenoid valve with two conical windings is provided. In a non-excited condition of the windings, the 4/3 directional solenoid valve assumes a neutral blocked or zero position associated with a neutral position of the piston of the control cylinder, while by alternatively exciting the windings by a control current the valve can be moved against a restoring force of pressure springs to its alternative flow positions, in which the piston of the control cylinder moves into its alternative end positions. A control stage is provided which responds to the output signals of end position pickups generating output signals characteristic of one or the other end positions of the control piston and to output pulses of a pulse generator provided for controlling the cycle and which generates necessary control current pulses for controlling the 4/3 directional solenoid valve in an appropriate manner by logic combination of the input signals.

Advantageously, the end position pickups include at least two approximation switches which, when occupying an position opposite a triggering finger which follows the movements of the piston of the control cylinder generates output signals characteristic of a given position, for instance, a high-level voltage signal, the end position pickups being slidable mounted on a guide element extended in parallel to a direction of movement of the triggering finger and arranged to be fixed at a selective distance from each other corresponding to the end position of the piston. The triggering finger is mounted, if necessary, for being displaceable on a piston rod projecting from a housing of the control cylinder and for being fixed thereon.

Advantageously, output signals of the actual positions emitted by the end position pickups are high-level voltage signals in the end positions of the control piston and output pulses of the pulse generator are also high-level voltage signals for a duration of successive feed and return motions of the cylinder, while for the rest of the time the same signals are low-level voltage signals. The control stage advantageously comprises a first storage circuit that can be set to high output signal levels by rising flanks of the output signals of the first end position pickup and reset by the rising flanks of output pulses of the second end position pickup. A second storage circuit can be set to high output signal levels by the rising flanks of the output pulses of the second end position pickup and reset by the rising flanks of the output pulses of the first end position pickup. A third storage circuit can be set to high output signal levels by dropping flanks of output pulses emitted by a pulse generated and reset by rising flanks of output pulses of the first end position pickup. A first AND gate with two inputs is provided to which output signals of the first storage circuit and output pulses of the pulse generator are applied as input pulses. A second AND gate with two inputs is provided to which the output pulses of the second and third storage circuits are applied as input signals. The output pulses of the two AND gates with two inputs can release the current control signal for controlling the 4/3 directional solenoid valve.

The presetting device of the present invention is particularly suited for punching machines for a plurality of operating cycles follow each other in rapid succession.

Considering that in the drive system of the invention the forces effective during the feed and/or return motions of the piston of the hydraulic cylinder are obtained by a controlled supply of pressure to the active working surfaces $A_1$ and/or $A_3$, or $A_2$, respectively, a pressure drop will be encountered in the pressure chambers of the hydraulic cylinder to which pressure is supplied via the pressure output of the control circuit, or balancing of the pressures active in the different pressure chambers, will be encountered each time the piston reaches one of its end positions. The invention therefore provides a monitoring system which responds in a characteristic manner to the pressures prevailing in the individual pressure chambers of the hydraulic cylinder, and by means of which it is easy to ascertain whether or not the piston of the hydraulic cylinder reaches the end positions corresponding to the pre-set values in the course of an operating cycle, and to derive therefrom information on the proper or incorrect, or insufficient operation of the drive system. If, for instance, the output pressure of the control system remains at high level after the drive system has changed over from rapid motion to working stroke, this is a safe indication that the piston of the hydraulic drive cylinder cannot complete its working stroke, either because, in the case of a punching die, the die may have become blunt, or because, in the case of a pressing or stamping die, the workpiece cannot be shaped as required, for instance because it is not properly supported. Insofar, the monitoring device may be used to indicate malfunctions of the machine. On the other hand, it is also possible to conclude from the pressure drop and/or equalization of pressure caused by the pressure control that the hydraulic cylinder has completed its working stroke and is approaching its end position, so that a corresponding output signal of the monitoring system can be used to trigger the pre-setting process for the return stroke already before the piston has actually completed the working stroke. In this manner, the working cycle times, for instance for repeated punching operations, can be still further reduced.

More particularly, according to yet further features of the present invention, a monitoring device is provided which responds to pressure in the first or the third pressure chambers and to pressure in the second pressure chamber of the hydraulic cylinder, and which generates a characteristic output signal as long as force is acting in the feed or return directions of a piston of the hydraulic cylinder are greater than certain predetermined threshold values.

The present invention also provides for a monitoring system using a double-acting differential piston wherein the ratio between the active working surfaces is equal to the ratio between the working surfaces of the piston of the hydraulic drive cylinder used for generating the forces acting in the opposite direction.

According to the present invention, the monitoring device includes at least one double-acting hydraulic cylinder having a piston defining a secondary pressure chamber which communicates with the first or second pressure chambers of the hydraulic drive cylinder against a second secondary pressure chamber which communicates with the second pressure chamber of the hydraulic drive cylinder, with the piston including a step piston having piston surfaces of larger and smaller piston steps which corresponds to cross-sectional surfaces of the secondary pressure chambers and exhibit the same ratio as effective cross-sectional surfaces of the connected pressure chambers of the hydraulic cylinder. The piston can be displaced against an increasing restoring force of an equilibrium position defined by a position between possible end positions.

In order to provide for a differential piston having a preferably miniaturized construction, according to the present invention, the piston surfaces of the stepped piston defining the secondary pressure chambers of the hydraulic cylinder of the monitoring device are much smaller than the effective piston surfaces of the piston of the hydraulic drive cylinder which define one side of the pressure chambers communicating with the secondary pressure chambers of the hydraulic cylinder of the monitoring device.

Advantageously, according to the present invention, a surface ratio of the surfaces of the stepped position defining the secondary pressure chambers of the hydraulic cylinder of the monitoring device, to surfaces of the piston of the hydraulic drive cylinder delimitating the pressure chambers of the hydraulic drive cylinder communicate with the secondary pressure chambers in a range between one/one hundred and one/two thousand and, preferably, one/one thousand.

This arrangement offers the advantage that the displacements of the differential piston of the monitoring system are always proportionate to the forces acting upon the piston of the hydraulic drive cylinder in the direction of the feed or return motion, so that when the differential piston is coupled with an analog displacement pickup, continuous registering of the forces generated within the drive system becomes possible.

For a great number of applications it will, however, suffice to use a monitoring system wherein at least two end position pickups connects with the double-acting hydraulic cylinder, the first of the end position pickups generating a characteristic output signal when the stepped piston is in one end position which is associated with an excessive pressure $P > P_{s1}$ in the first secondary pressure chamber of the hydraulic cylinder of the monitoring device. The second end position pickup generates a characteristic output signal when the step piston is in its outer end position associated with excessive pressure in the second secondary control chamber of the hydraulic cylinder of the monitoring device.

A first monitoring device is provided whose first secondary pressure chamber communicates with the first pressure chamber of the hydraulic drive cylinder and a second monitoring system whose first secondary pressure chamber communicates with the third pressure chamber of the hydraulic drive cylinder while the second secondary pressure chamber of the monitoring devices communicate with the second pressure chamber of the hydraulic drive cylinder.

With such an arrangement, it is possible to register only the end positions of the differential piston and/or to monitor the maximum forces acting in the feed and return directions of the hydraulic cylinder.

Features described by claims 21 and/or 22, which is designed to register only the end positions of the differential piston and/or to monitor the maximum forces acting in the feed and return directions of the hydraulic cylinder.

To define particularly advantageous applications for a drive system in accordance with the present invention, a hydraulic drive system may be utilized in punching or nipple machines for raid succession of work cycles and performance of three hundred to six hundred work cycles per minute. It is also possible for the hydraulic drive system of the present invention to be utilized in presses or stamping machines.

Further details and features of the invention will become apparent from the following description of certain examples of embodiments of the invention when read with reference to the drawings.

DETAILED DESCRIPTION

Figure 1:
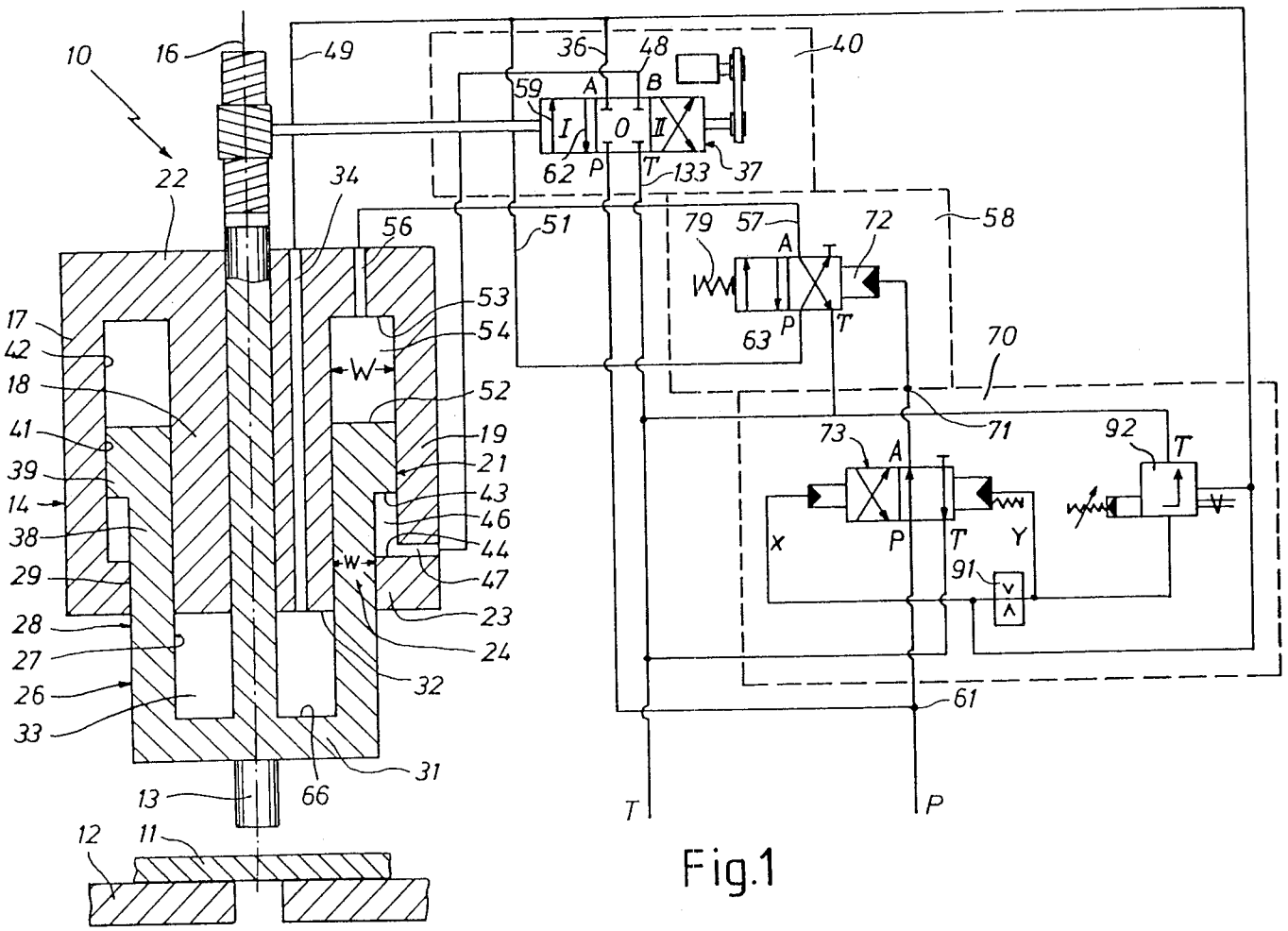
FIG. 1 is a schematic view of a general design of a drive system in accordance with the invention, comprising a hydraulic drive cylinder with three working faces, whose motions are controlled by means of a hydraulic control circuit, and a reversing valve with hydraulic pilot control for controlling the rapid-motion and load conditions of the hydraulic drive cylinder.

Without limiting the generality of this description, the hydraulic system generally designated by the reference numeral 10 shown in FIG. 1 will be described hereafter as the drive coupling of a stamping or punching machine designed to perform a particularly high number of cycles within a given time unit. As an approximate value, we will assume hereafter that the machine and/or its drive system 10 is capable of performing 600 similar cycles per minute i.e. of punching, for instance, 600 circular holes from a workpiece 11 that can be displaced a defined length along a machine table 12, in synchronism with the working cycles of the machine. Each working cycle comprises at least one rapid feed motion during which the tool—a punching, stamping or pressing die, depending on the purpose of the machine—is fed towards and against the workpiece 11 at high speed, and a working stroke performed in the same direction, during which the tool 13 penetrates into, and pierces, if required, the workpiece 11, and finally a rapid return motion by which the tool 13 is rapidly returned, after completion of the desired operation on the workpiece 11, into an initial position suited for commencing the next operating cycle.

In order to ensure that the tool 13 can properly perform the desired shaping operation, the feeding power required for performing the working stroke can be increased as required in response to the load with the feeding speed being reduced accordingly.

The drive element of the drive system 10 of the invention includes a hydraulic cylinder designated generally by 14. FIG. 1 shows a cross-section through the cylinder in that plane containing its longitudinal center axis 10 in which the connection lines and channels utilized for the motion control can be seen, too.

The housing 17 of the hydraulic cylinder 14 by which the latter is mounted on a machine body in the drawing, has substantially the shape of a pot with its open end facing downwardly in the drawing. This pot comprises a solid cylindrical core 18 defining together with the cylindrical outer wall 19 a long annular space 21. The annular space is closed at the top by a solid bottom or top plate 22 of the cylinder housing 17, and at its bottom end its diameter is a little reduced by a flange projecting radially inwardly from its outer jacket 19, so that the interior width W of an annular gap 24 remaining between the core 18 of the cylinder housing and its flange 23 and forming the passage for the piston of the hydraulic cylinder, which is itself substantially pot-shaped and generally designated by 26, is somewhat smaller than the interior width w of the annular space 21 of the cylinder housing 17 measured between the core 18 and the inner wall of the outer jacket 19 of the cylinder housing 17.

As appears in detail in FIG. 1, the piston 26 of the hydraulic cylinder 17 is slidably guided in pressure-tight relationship, by the inner face 27 of its jacket on the cylindrical core 18 of the cylinder housing, and by the outer face 28 of its jacket on the cylindrical counterface of the flange 23 of the cylinder housing 17. The bottom 31 of the piston 26 and the opposite end face 32 of the cylinder housing core 18 delimit in the axial direction a first pressure chamber 33 which can be connected, via a control channel 34 extending longitudinally through the core 18, to the A working connection 36 of a control valve arrangement serving to control the feed and return motions of the piston 28. Further, the piston 26 is provided on the upper end of its jacket 38 with a piston flange 39 extending radially outwardly and exhibiting a cylindrical outer face 41 extending coaxially to the longitudinal axis 16, by which outer face 41 the piston is slidable guided, in pressure-tight relationship, on the inner face 42 of the jacket of the cylinder housing 17.

The lower, as viewed in FIG. 1, narrow annular surface 43 of the flange 39 and the inner radial annular surface 44 of the housing flange 23 delimit in the axial direction a pressure chamber 46 formed between the housing 17 and the piston 26, which pressure chamber 46 can be connected via a control channel 47 to another B working connection 48 of the control valve arrangement 40. Control pressure lines 49 and 51 serve to connect the control channels 34 and 47 with the control valve arrangement 40. The inner width of the second pressure chamber 46, measured in the radial direction, corresponds to the difference W−w of the inner widths of the annular chamber 29 and the annular gap 24 remaining between the housing flange 23 and its core 18. Further, a third pressure chamber formed between the cylinder housing 17 and the piston 26 is delimited in the axial direction by the upper end face 52 of the piston 26 or its radial flange 39, and the opposite broad annular face 53 of the housing cover plate 22. The width of the third pressure chamber 54, measured in the radial direction, is equal to W. The third pressure chamber 54 communicates via a control chamber 56 with the A working connection 57 of a pressure controlled reversing valve 58 which connects the said pressure chamber 53 in its alternate switching positions either with the tank or with the A connection 36 of the control valve arrangement 40. When, as in the position shown in the drawing, the reversing valve 58 occupies the position in which the third pressure chamber 54 is connected with the tank and the control valve arrangement 40 represented by a 4/3 directional valve assumes the first flow position marked I, in which the first pressure chamber 33 of the hydraulic cylinder is connected via the flow path indicated by the arrow 59 to the high-pressure outlet 61 of the pressure source not shown in the drawing, while at the same time the second pressure chamber 46 is connected with the tank via the flow path of the 4/3 directional valve 37 indicated by the arrow 62, the piston 28 of the hydraulic cylinder 14 performs the rapid feed motion. When, with the 4/3 directional valve 37 in its flow position I, the reversing valve 58 is caused to assume its other position, in which its pressure supply connection (P connection) connected to the A working connection 36 of the 4/3 directional valve 37 communicates with the third pressure chamber 54 of the hydraulic cylinder 14, via the flow path indicated by arrow 64, so that the high output pressure of the pressure source is applied to this pressure chamber, the piston 26 performs its working stroke with increased feeding power.

When the 4/3 directional valve 37 occupies its flow position marked II and the reversing valve 58 is simultaneously in the position shown in the drawing, the first pressure chamber 33 and the third pressure chamber 54 are connected to the tank, and only the second pressure chamber 56 communicates with the high-pressure outlet 61 of the pressure source so that the piston 26 performs its rapid-return motion.

In cases where a very rapid succession of the working cycles is demanded, the hydraulic cylinder 14 should conveniently be sized so that the feeding power $F_v$ effective during the rapid feeding motion, which is equal to the product $A_1 \cdot p$, wherein $A_1$ is the size of the end face 32 of the housing core 18 for the inner bottom face 66 of the piston 26, and p is the output pressure at the A working connection of the control valve arrangement 40, is sufficiently high to effect also a working stroke of the piston 26 and the tool 13. In this case, the additional supply of pressure to the third pressure chamber 54, which can be achieved by changing over the position of the reversing valve 58 and which serves to increase the feeding power, will be necessary only in certain extreme situations, or for instance if the force required for forcing the tool into the workpiece 11 rises as the tool wears down, in which case any reversal from the rapid-feed motion to the working motion would have to be regarded as an indication of the impending necessity to change the tool. It goes without saying that where workpieces 11 of relatively important material thickness are to be worked, the operation of the device 10 may be such that the reversal from rapid motion to working motion is effected during each cycle.

The correct actuation of the reversing valve 58, in accordance with the requirements, is effected by a pilot control valve arrangement generally designated 70, whose alternative high and low-level pressure output signals serve to move the reversing valve 58 into its alternative switching positions corresponding to the rapid-feed motion and the working stroke, respectively. In detail, this pilot control valve arrangement 70 functions as follows: As long as—in the rapid-feed motion of the hydraulic cylinder 14 the output pressure at the A working connection of the control valve arrangement 37 or in the first pressure chamber 33 of the hydraulic cylinder 14 remains below a pre-determined threshold value $P_{s1}$, the output pressure prevailing at the outlet 71 of the pilot control valve arrangement and applied to the control pressure chamber 72 of the reversing valve 58 has the same—high or low—level at which the reversing valve 58 is moved into and held in the position corresponding to the rapid motion operation of the hydraulic cylinder 14.

When the pressure prevailing in the first pressure chamber 33 of the hydraulic cylinder exceeds the said threshold value $P_{s1}$, which happens when the feeding power made available for the rapid feed motion by the supply of pressure to the said first pressure chamber 33 alone does not suffice, for instance to force the tool 13 through the workpiece 11, the pilot control valve arrangement 70 reacts by changing over one if its pilot control valves 73, which is likewise pressure-controlled, so that the pressure supplied at the outlet 71 of the pilot control valve arrangement adopts that, lower or higher, level which causes the reversing valve 58 to move into the position corresponding to the working stroke, in which the—high—output pressure of the control valve arrangement 37 is supplied also to the third pressure chamber 54, in addition to the first pressure chamber 33. Accordingly, the output pressure of the pilot control valve arrangement 70 remains at the level associated with that position of the reversing valves 58 which corresponds to the working stroke as long as the pressure p applied to the two pressure chambers 33 and 54 satisfies the relation:

$$P_{s2} \geqq P_{s1} \cdot q \cdot A_1/(A_1+A_3) = P_{s1} \cdot q \cdot A_1/A_L$$

wherein $A_3$ is the size of the end face 52 of the piston 26 additionally used as working surface for the working stroke, $A_L = A_1 = A_2$ is the total surface upon which pressure is applied during the working stroke, and q is a factor which should be conveniently selected to satisfy the formula $$0.8 < q < 0.95.$$

When the pressure p prevailing in the two pressure chambers 33 and 54 drops below the value $P_{s1} \cdot q \cdot A_1/(A_1+A_3)$, the pilot control valve arrangement 70 reacts by switching the pilot control valve 73 back to its former position, so that the reversing valve 58 also returns to its operating position corresponding to the rapid feed motion.

Figure 2:
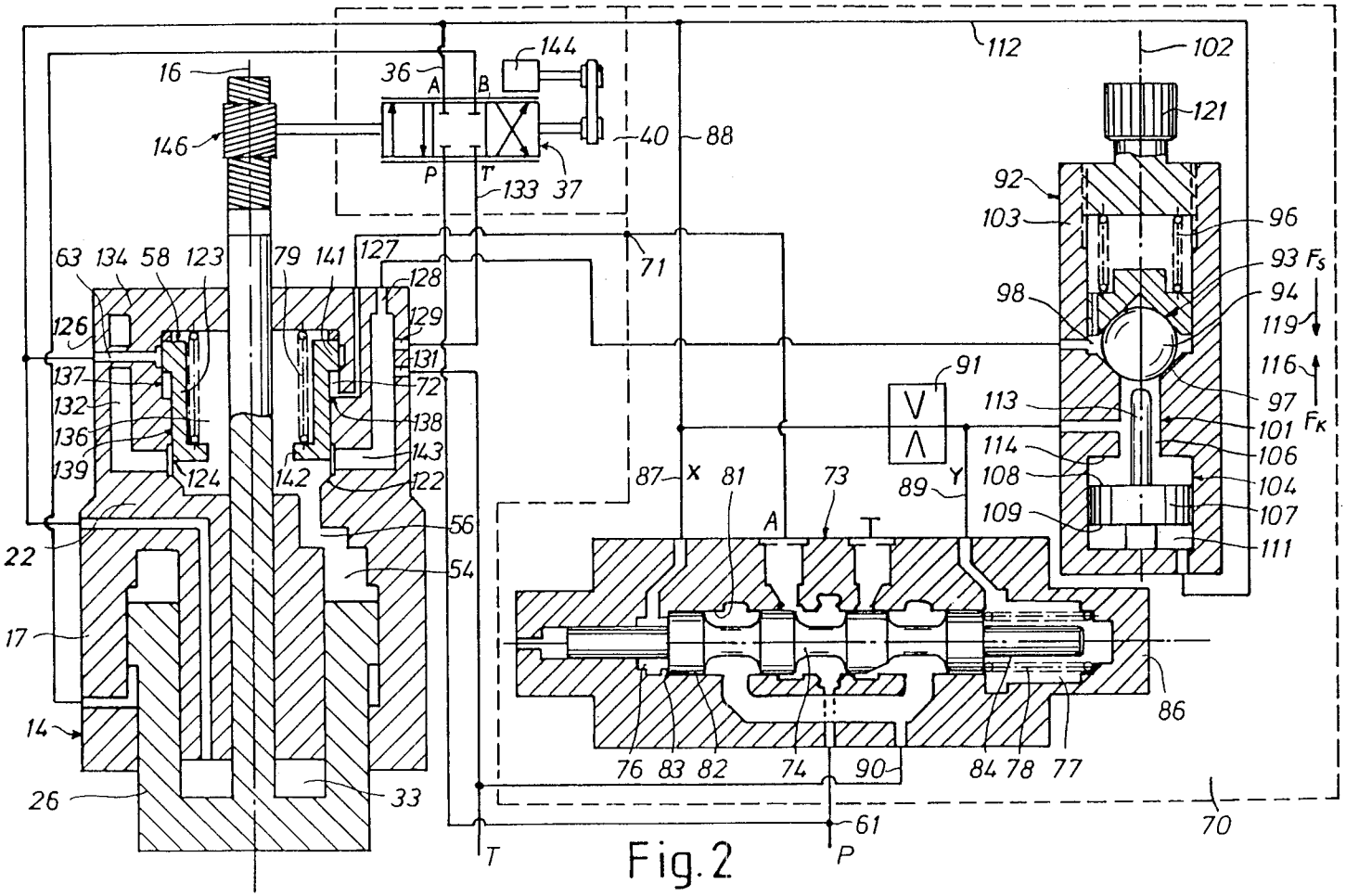
FIG. 2 is a schematic view of a preferred embodiment or a drive system in accordance with the invention having the reversing valve integrated into the housing of the hydraulic drive cylinder, and details of the pilot valve arrangement provided for reversing the reversing valve, in an operating condition corresponding to the rapid-motion condition of the drive system.
Figure 3:
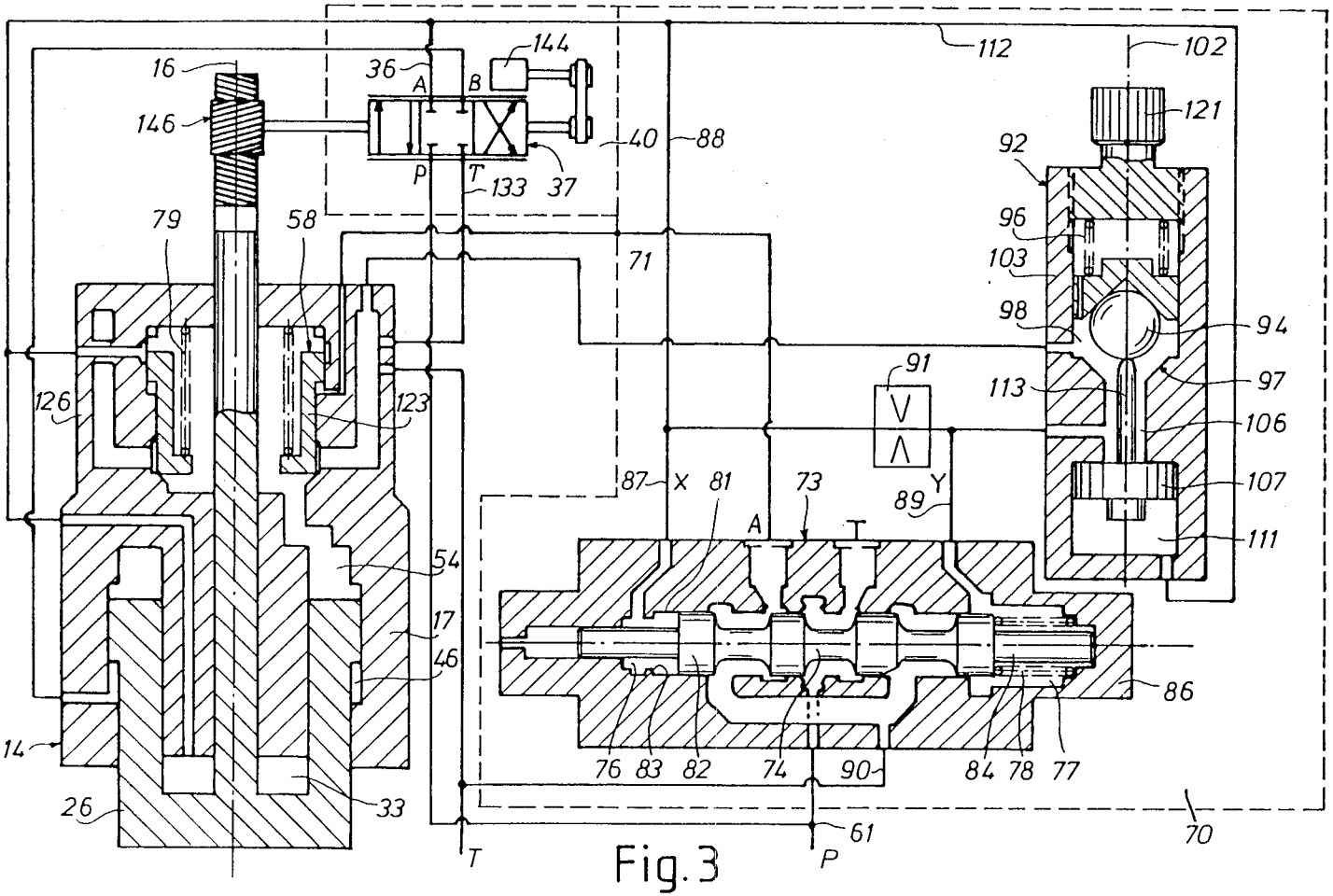
FIG. 3 is a schematic view of the drive system of FIG. 2 in an operating position corresponding to working stroke motion.

In order to achieve the before-described function of the pilot control valve arrangement 70 and to ensure quick operation, the valve arrangement is given the design represented in more detail in FIG. 1 and, as regards the constructional details, in FIGS. 2 and 3. While FIGS. 1 and 2 show the reversing valve 58 and the pilot control valve arrangement 70 in the operating positions corresponding to the rapid-feed motion, FIG. 3 shows the same arrangements in the positions corresponding to the working stroke. The representations start from the assumption that the reversing valve 58 is moved into the operating position corresponding to the rapid-feed motion and the rapid-return motion by the high-level output pressure of the pilot control arrangement 70, and into the position corresponding to the working stroke by the low-level output pressure of the pilot control valve arrangement 70.

The pilot control valve 73 used as output stage for the pilot control valve arrangement 70 takes the form of a 3/2 directional sliding valve whose piston 74, viewed in the axial direction, is arranged between two control pressure chambers 76 and 77. By applying pressure to the pressure chambers 76 and 77 in opposite directions, effective control forces can be exerted upon the piston 74. If the same pressure prevails in both pressure chambers 76 and 77, the piston 74 is urged by a biased return spring 78 into its normal position shown in FIG. 2, in which the A working connection 79 of the pilot control valve 73 communicates with the high pressure outlet 61 of the pressure source. In this position, the pressure is applied also to the control pressure chamber 72 of the reversing valve 78, and the latter is retained in the flow position associated with the rapid-motion operation by the restoring force of a biased pressure spring 79. The piston 74 of the pilot control valve 73 is in its normal position when its piston flange 82 which delimits the left control pressure chamber 76, as viewed in FIG. 2, against the valve bore 81 rests against a stop 83 in the valve bore 81. The piston 74 assumes its second, alternate position—i.e. the operating position shown in FIG. 3, when the pressure in the left control pressure chamber 76—as viewed in FIGS. 2 and 3, exceeds the pressure prevailing in the opposite, right hand control pressure chamber 77 by an amount sufficient to displace the piston 74 towards the right, against the restoring force of the pressure spring 78. This second operating position is defined by the contact between a spacer pin 84 and the end wall 86 of the right-hand control pressure chamber 77.

In this second operating position of the piston 74 and/or the pilot control valve 73, the A working connection 71 communicates with the tank T of the pressure source via the tank connection (T) 86. Consequently, the pressure in the control pressure chamber 72 of the reversing valve 58 assumes the lower level of the tank so that the valve is moved, by the restoring force of its control pressure spring 79, into its second flow position associated with the load-feed motion, in which the third pressure chamber 54 of the hydraulic cylinder 14 is connected with the A working connection 36 of the control valve arrangement 37 via the flow path 64 (FIG. 1).

As illustrated by the pressure line 88, the x control connection of the left-hand control pressure chamber 76 of the pilot control valve 73 in FIGS. 2 and 3 is directly connected with the A working connection 36 of the control valve arrangement 37. The y control connection 89 of the right-hand control pressure chamber 77 of the pilot control valve 73 in FIGS. 1 to 3 is connected with the x control connection 87 of the pilot control valve 73 and/or the A working connection 36 of the control valve arrangement 37 via a flow resistance 81 taking the form of a restrictor or throttle element.

The pilot control valve arrangement 70 further comprises an over-center device generally designated 92 and designed in the manner of a proportioning pressure regulator, which during rapid-feed operation maintains the pressure threshold to which the pilot control valve 73 responds at the value $P_{s1}$, while after a change-over of the pilot control valve 73 and/or the reversing valve 58 from rapidfeed motion to working stroke lowers the lower pressure threshold to the value $p_{s1} \cdot q \cdot A_1(A_{1+A3})$. The lower pressure threshold, as this term is used herein, defines the limit which, when the pressure drops below it, causes the pilot control valve 73 to resume its switching position corresponding to the rapid-feed motion.

The over-center device comprises a ball valve generally designated 93. The valve body 94 of the said ball valve is urged against a conical valve seat 97 by a pressure spring 96 whose bias can be selectively adjusted. In the initial position of this ball valve 93, in which the ball 94 bears in sealing relationship against the seat 97, an annular space 98 directly connected to the tank T of the preesure source is shut off against an output pressure chamber generally designated 106 which communicates with the control connection 89 of the second, in FIG. 2 right-hand, control pressure chamber 77 of the pilot control valve 73. The said output pressure chamber is delimited and sealed in the axial direction against a control pressure chamber 111 by a free piston 107 arranged for reciprocating movement along the longitudinal axis 102 of the housing 103 of the over-center device 92. The control pressure chamber 111 is connected with the A working connection 36 of the control valve arrangement 40 via a control pressure line 112. The free piston 107 is arranged within the larger step 104 of a stepped bore 101, 104 the narrower step 104 of which is arranged adjacent the valve seat 97. The free piston 107 is provided with a spacer pin 113 pointing towards the valve ball and serving to retain the ball 94 in a position lifted off the valve seat 97, as shown in FIG. 3, when sufficient pressure is applied on one side of the free piston 107 from the control pressure chamber 111 to urge the piston into its upper end position, as viewed in FIG. 3. The free piston 107 occupies its upper end position when it rests against the shoulder face 114 defining the narrower step 101 against the wider step 104 of the bore in the housing 103 of the over-center device.

The drive system 10 described above operates as follows over one of several working cycles, for example, one of several periodically repeated working cycles with fixed phase sequence:

In the initial rapid-feed phase, the control valve arrangement 40 occupies its operating position 1 so that the first pressure chamber 33 of the hydraulic cylinder 14 is connected with the pressure output 61 of the pressure source, while the second pressure chamber 46 is connected with the tank of the pressure source.

The pilot control valve 73 whose one pressure chamber 76 is directly connected, via a pressure line 88, to the A working connection 36 of the control valve arrangement 40, and whose other pressure chamber is connected to the same connection via the flow resistance 91, is initially retained in its initial position under the effect of its restoring spring 78 and, in the stationary condition of the rapid-feed motion, also by the uniform pressure applied to the two control pressure chambers 76 and 77. Accordingly, high-level pressure is applied to the control pressure chamber 72 of the reversing valve 58, and as a result thereof the reversing valve 58 assumes that flow position in which the third pressure chamber 54 of the hydraulic cylinder 11 communicates with the tank. The feeding speed v of the piston 26 of the hydraulic cylinder 14 obtained in the rapid-feeding phase is then defined by the relation $$v = Q/A_1,$$

wherein Q is the volumetric displacement of the pressure pump, related to a time unit. The pressure P in the first working pressure chamber 33 of the hydraulic cylinder is in this phase relatively low as the pressure pump has to work only against the flow resistance of the valve channels and the pressure lines through which the fluid enters the pressure chamber 33 or leaves the second and the third pressure chambers 46 and 54.

In this rapid-feed phase, the two surfaces 108 and 109 of the free piston 107, which have the size $a_2$, are subjected in opposite direction to the output pressure of the control valve arrangement 40. The piston 107 is in the state of equilibrium of forces. Due to the pressure p prevailing in the, shut off, output pressure chamber 106, the ball 94 is subjected to a force $F_k = p \cdot a_1$ acting in the direction indicated by the arrow 116, wherein $a_1$ is the size of the circular surface encircled by the valve seat 97. The valve ball 94 is pressed in sealing relationship against its valve seat 97 by the oppositely directed restoring force $F_S$, arrow 119, of the pressure spring 96 which can be selectively biased by a set screw 212. The valve ball 94 is retained in this position as long as the said restoring force $F_S$ remains greater than the counteracting force $F_k$ resulting from the pressure applied to the valve ball 94. So, the value of the threshold pressure $p_{s1}$ at which the hydraulic cylinder 14 is to be changed over from rapid-feed to working stroke can be ajudsted by adjusting the bias of the pressure spring 96.

Now, when the tool 13 gets into contact during the rapid-feed phase with the workpiece 11, the resistance to be overcome by the pressure pump in delivering the fluid into the first pressure chamber 33 of the hydraulic cylinder 14 increases, and the pressure p encountered in this pressure chamber 33 and/or at the outlet 36 of the control valve arrangement 37 increases accordingly. If in consequence of this pressure rise the threshold value Phd s1, typically approx. 70 to 80% of the maximum delivery pressure of the pressure pump of approx. 200 bar, is exceeded so that the force $F_k$ acting on the valve ball 94 exceeds the restoring force $F_S$ of the pressure spring 96 of the over-center device 92, then the valve ball 94 is lifted off its seat 97 so that the output pressure chamber 106 arranged adjacent the latter communicates with the tank T. Due to the throttle effect of the flow resistance 91, the abrupt pressure drop in the output pressure chamber 106 resulting therefrom is imparted only to the second, in FIGS. 1 to 3 right-hand—pressure chamber 77 of the pilot control valve 73 which thereupon assumes its second flow position associated with the working stroke and shown in FIG. 3, in which the A outlet 71 of the pilot control valve 73 and, thus, the control pressure chamber 72 of the reversing valve 58 communicate with the tank T, the valve is moved by the action of its pressure spring 79 into its second flow position in which the third pressure chamber 54 is also subjected to the high output pressure of the control valve arrangement 40 so that the working stroke of the hydraulic cylinder is iniated.

As long as the output pressure chamber 106 of the overcenter device 92 communicates with the tank T and the free piston 107 is subjected to the high output pressure P of the control valve arrangement 40 in one direction only, the free piston 107 is retained in contact with the step face 114 and the valve ball 94 is held by the spacer pin 113 of the free piston at a distance from the valve seat 97, and this at least as long as the force defined by the relation $F_{k'}=P\cdot a_2$ and now acting in the direction indicated by the arrow 116 upon the valve ball 94 remains greater than the restoring force $F_s$ of the pressure spring 96.

The ratio between the surface $a_1$ enclosed by the valve seat 97 and the size $a_2$ of the surfaces 108 and 109 of the free piston 107 is selected to be substantially equal to the ratio $A_1/(A_1+A_3)$ of the piston surface of the hydraulic cylinder, according to the following formula $$a_1/a_2=q\cdot A_1(A_a+A_3).$$

Now, when the pressure p in the two pressure chambers 33 and 54 of the hydraulic cylinder 14 drops again, for instance in the case of a punching process when the tool 13 has pierced the workpiece 11, the ball valve 93 of the over-center device 92 returns to its closed position shown in FIG. 2 as soon as the pressure drops below the threshold value $p_{s1}=F_S/a_2$, i.e. at a pressure which is by about the before-mentioned surface ratio lower than the threshold value $p_{s1}$ at which the system is changed over from rapid-feed operation to working stroke. A residual feed motion, if any, is then again effected by the hydraulic cylinder 14 in rapid-feed operation.

The surface ratio $a_1/a_2$ which is of decisive importance in the before-described switching operation and which can be pre-determined by suitable sizing of the over-center device, is conveniently selected to ensure that the pressure drop at the outlet of the control valve arrangement 40 directly connected with a change-over from rapid-feed to working stroke cannot immediately initiate a reverse change-over from working stroke to rapid-feed operation.

During the return motion of the hydraulic cylinder 14, which follows the feed motion and which is initiated by the change-over of the control valve arrangement 37 to its operating position II, the second pressure chamber 46 of the said hydraulic cylinder 14 is subjected to the high output pressure P of the pressure source, while the first pressure chamber 33 communicates with the tank via the working connection 36 of the control valve arrangement 40. Accordingly, the control pressure chamber 72 of the reversing valve 58 is also supplied with this high output pressure which means that the reversing valve 58 is moved into its first flow position in which the pressure chamber 54 of the hydraulic cylinder 14 likewise communicates with the tank, so that the return motion of the piston 26 of the hydraulic cylinder is performed as rapid motion.

For the purposes of the following explanations, a system 10 will be assumed in which the ratio $A_1/A_2$ of the active working surface 32 ($A_1$) of the first pressure chamber 33 to the active working surface 43 ($A_2$) of the second pressure chamber 46 of the hydraulic cylinder 14 is 4/1 and in which the ratio $A_3/A_4$ of the active working surface 52 ($A_3$) of the third pressure chamber 54 of the hydraulic cylinder 14 to the active surface of its first pressure chamber 33 is likewise 4/1. This means that during rapid-feed operation of the system 10, the quantity of fluid (pressure oil) flowing from the tank T to the third pressure chamber 54 of the hydraulic cylinder 14 is four times greater than the quantity of fluid introduced at the working pressure P into the first pressure chamber 33 of the hydraulic cylinder 14, via the control valve arrangement 33, and 16 times greater than the fluid quantity flowing from the tank into the second pressure chamber 46 of the hydraulic cylinder, via the control valve arrangement 40, and that during rapid-return operation of the system 10 the quantity of pressure fluid flowing through the reversing valve 58 from the third pressure chamber 54 of the hydraulic cylinder 14 to the tank T is also four times greater than the fluid quantity flowing from the first working pressure chamber 33 of the hydraulic cylinder 14 to the tank via the control valve arrangement 37.

In order to minimize the flow resistances relative to the larger fluid quantities passing through the reversing valve 58, and to make the best possible use of the piston speeds achievable by the working surface ratios of the hydraulic cylinder 14, the reversing valve 58 has the design shown in detail in FIGS. 2 and 3, where the arrangement is incorporated in the hydraulic cylinder 14:

The reversing valve 58 is of the seat valve type, having a conical valve seat 122 and a valve body 123 with annular sealing edge 124.

Assuming an upright arrangement of the hydraulic cylinder 14, the valve housing 126 is arranged immediately above the top plate 22 of the cylinder housing 17 and forms sort of an axial extension thereof.

The valve housing 126 is arranged symmetrically to the longitudinal axis 16, except for the arrangement of a channel which forms the P supply connection 63 of the reversing valve 58 and which is connected to the A working connection 36 of the control valve arrangement 37; the arrangement of a control channel 127, which opens into the control pressure chamber 72 of the reversing valve and which is connected to the outlet 71 of the pilot control valve arrangement 70; and other connection channels 128, 129 and 131 which serve to connect a—relative to the central longitudinal axis 16'—outer, large-volume annular space 132 with the annular space 98 of the over-center device 92, the T supply connection 133 of the control valve arrangement 40 and the tank T itself. The central housing space 136 which is closed at the top by a top plate 134 of the reversing valve housing 126 and at the bottom by the top plate 22 of the cylinder housing 17 and in which the valve body 123 can be reciprocated in axial direction, takes the form of a stepped bore having an upper larger step 137 and a lower narrower step 139 separated by a narrow radial annular face 138, the lower narrower step 139 being followed by the downwardly tapering conical valve face.

The valve body 123, as shown in FIGS. 2 and 3, takes the form of a cylindrical piece of tube open at the top and at the bottom and guided in the bore in pressure-tight relationship, the outer surface of the valve body being in contact with the wall of the narrower step of the bore 139, and the cylindrical outer surface of the flange 141 projecting radially outwardly from its upper end portion being in contact with the wall of the larger step of the bore 137. The radial flange 141 and the radial annular face 138 of the stepped bore 137, 139 delimit, in the axial direction, the control pressure chamber 72 formed between the valve housing 136 and the valve body 122.

The valve body 123 is provided on its lower end with a narrow annular flange 142 projecting radially inwardly. The biased pressure spring 79 which urges the valve body 123 against its seat 122, or which provides the restoring force against which the valve body 123 is lifted off the seat 122 when a sufficiently high pressure is applied to the control pressure chamber 132, is arranged between the said narrow annular flange 142 and the top plate 134 of the valve housing 126. A plurality of short transfer ports arranged in axial symmetry and performing together the function of the control channel 56 of the reversing valve 58 connect the central housing space 156 of the reversing valve 58 in any position of the valve body 123 with the third pressure chamber 54 of the hydraulic cylinder 14. Other transfer ports 143 lead from the outer annular space 132 to the central housing space 136 and open into the central housing space 136 just above the valve seat 122. In the first flow position of the reversing valve 58 which corresponds to the rapid motion operation of the system 10 and which is represented in FIG. 2, these ports are open so that fluid is admitted from the third pressure chamber 33 of the hydraulic cylinder 14 directly into the annular tank space 132, over extremely short flow paths and with favourably low flow resistances. In the second flow position of the reversing valve 58 shown in FIG. 3, these transfer ports 143 are shut off; instead, the central housing space 136, and the third pressure chamber 54 of the hydraulic cylinder 14 communicating with it, are connected with the A working connection 36 of the control valve arrangement 40. This arrangement and design of the reversing valve 58 ensures that inspite of small valve dimensions, favorably short transfer paths with large cross-sections and, thus, favorably small flow resistances are obtained for both flow positions of the reversing valve 58, so that piston speeds practically equal to the theoretical values and very high work cycle frequencies can be achieved.

Figure 4:
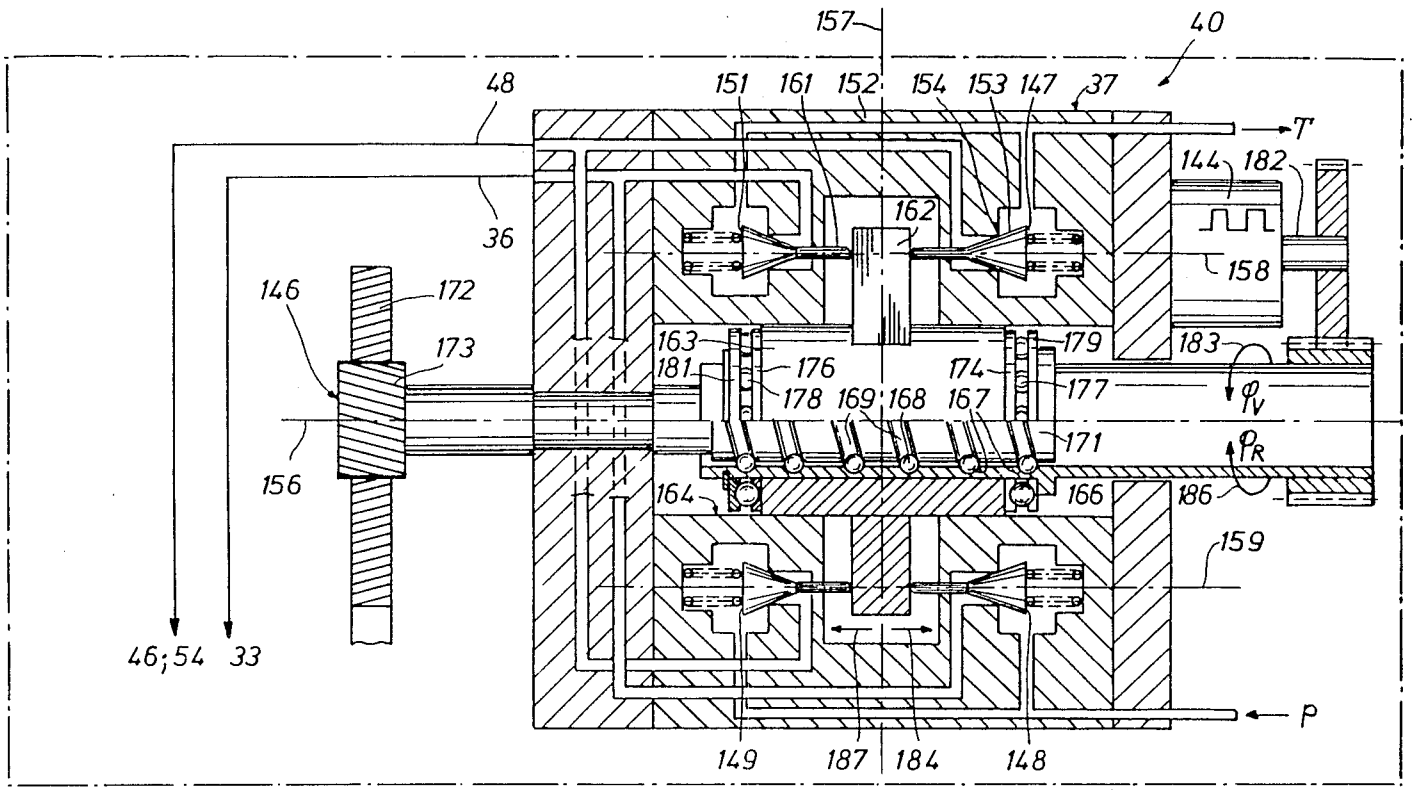
FIG. 4 is a schematic detail view of a follow-up control valve with a pre-setting device controlled by a stepping motor and mechanical nominal-value feedback, provided within the control circuit for controlling the motions of the piston of the hydraulic drive cylinder.

In a preferred embodiment of the drive system 10 of the invention, the control valve arrangement 40 which is provided for controlling the direction and length of the feed and return motions of the piston 26 of the hydraulic cylinder 14 in a convenient manner and which, thus, must itself be designed for high work cycle frequencies, has the design shown in detail in FIG. 4.

From FIG. 4 it appears that the control valve arrangement 40 comprises a 4/3-directional follow-up control valve 37 in which the direction and set value of the feed and return movements can be preset, in the particular case described, by means of a stepping motor 144 controlled in start-stop operation by a 5 KHz square-wave signal. Further, a feed-back device generally designated 146 is provided for feeding back the actual value of the instantaneous position of the piston 26. The ¾ follow-up control valve 37 which in its operating position 1 connects the first pressure chamber 33 of the hydraulic cylinder 14 and the supply connection 43 of the reversing valve 58 with the high-pressure outlet 61 of the pressure source, and the second pressure chamber 46 of the hydraulic cylinder 14 with the tank, and in its operating position 2 corresponding to the return motion connects the first pressure chamber 33 of the hydraulic cylinder 14 and the supply connection 63 of the reversing valve 58 with the tank, and the second pressure chamber 46 of the hydraulic cylinder 14 with the pressure outlet 61 of the pressure source, and which in its closed position 0 shuts these pressure chambers 63 and the said supply connection 63 off against the pressure outlet 61 of the pressure source and its tank, comprises in the embodiment shown a total of four seat valves 147 and 148, and 149 and 151, all accommodated in a common housing 152 in the arrangement shown in FIG. 4.

Each of the said seat valves comprises a valve body 153 in the form of a truncated cone and an annular valve seat 154 fixed to the housing. The seat valves are arranged in pairs in symmetry relative to the transverse center plane 157 of the housing 152 of the follow-up control valve 137, which extends perpendicularly to the longitudinal center axis 156. The valve bodies 153 of the valve pairs 147, 151 and 148, 149 arranged opposite each other relative to the said transverse center plane 157, can be displaced along an axis 158 or 159, respectively, extending in parallel to the longitudinal axis 156 of the valve housing 157.

In the represented closed (neutral) position of the follow-up control valve 37, all seat valves 147, 148, 149 and 151 are closed and their valve bodies 153 bear via a pin 61 against an actuating element 162 in the form of a radial flange. The actuating element 162 is guided in the housing 152 for reciprocating movement along its longitudinal axis 156. The actuating element 162 is fixed to a tubular sleeve 163 guided in a central bore 164 of the housing block 152 of the follow-up control valve 37 for reciprocating movement along its centre axis 156. The sleeve 163 encloses an elongated tubular rotatable spindle nut 166 whose thread grooves 167 engage the thread 169 of a spindle 171, via balls 168. In the embodiment shown, the spindle 171 is fixed against rotation to the shaft of a toothed wheel 173 provided as part of the feed-back device 146 and engaging a toothed rack 172. The shaft of the toothed wheel 173 is seated on the housing 52. The sleeve 163 carrying the actuating element 162 extends between the inner rings 174 and 176 of axial ball bearings 177 and 178, while the outer rings 179 and 181 thereof are fixed against rotation and displacement on the spindle nut 166 in the arrangement shown in FIG. 4. So, the sleeve 163 and, thus, the actuating element can follow any axial movements performed by the spindle nut 166 as a result of a rotary movement of the spindle nut itself or the spindle 171, without following the rotary movements of the spindle nut 166. The spindle nut 166 is positively coupled with the drive shaft 182 of the stepping motor 144, either directly or via a toothed belt or spur gear, as shown in FIGS. 2 to 4. So, the spindle nut 166 can be rotated by pre-determinable defined angular amounts, by triggering a stepping motor 144 in an appropriate manner.

When, starting from the neutral closed position of the 4/3 follow-up control valve 37, the stepping motor is electrically triggered to rotate the spindle nut 166 by a defined angle $\phi r$ in the direction by arrow 183, in counter-clockwise direction this initially lead to the actuating element 162 being displaced in axial direction, arrow 184, so that the two seat valves 147 and 148 which in FIG. 4 can be seen in the right upper portion of the valve housing 152 open, while the seat valves 149 and 151 arranged in the left portion of the valve housing 152 remain closed. Consequently, the follow-up control valve 37 assumed its operating position I corresponding to the rapid-feed motion and working stroke.

When, on the other hand, the stepping motor 144 is triggered to rotate over a given number of stepping pulses in the direction indicated by arrow 186, by a defined angular amount $\phi_R$ determined by the predetermined number of stepping pulses, whereby the actuating element 162 is displaced from the neutral-position in the direction indicated by arrow 187 in FIG. 4, i.e. to the left, the follow-up control valve 37 assumes its operating position II in which the valve bodies 153 of the seat valves 149 and 151, which according to FIG. 1 are arranged to the left of the transverse centre plane 157 of the valve housing 152, are lifted off their seats 154 so that the A working connection 36 of the follow-up control valve 37 communicates with the tank, while the high output pressure of the pressure source is supplied to the B working connection 48 of the follow-up control valve 37. This is the operating position II associated with the return motion of the hydraulic cylinder 14.

As can be seen best from FIGS. 2 and 3, the back-feeding device 146 is provided with a toothed rack 172 coupled with the piston 26 to move with it, via a piston rod which extends in axial direction and centrally through the housings 126 and 17 of the reversing valve 58 and the hydraulic cylinder 14 and which is slidably guided in the said housing in pressure-tight relationship. The angular amount of any rotation of the spindle 171 effected by the back-feeding device is a very exact measure of the length of the travel performed by the piston 26 in the feed or return direction. In rotating the spindle 171, the back-feeding device 146 displaces the actuating element 162 in a direction opposite to that of the movement performed by the actuating element 162 due to the respective pre-set value, so that the actuating element 162 assumes its neutral position corresponding to the closed position of the control valve 37 exactly at the moment when the piston 26 reaches the end position of its feed or return movement corresponding to the pre-set value.

When the operational control of the hydraulic cylinder 14 is realized in the manner described above, its piston approaches its end positions in the last phases of its feed and return motion at a rapidly decreasing speed. In the end position, the forces acting upon the piston are just balanced. Thus, the drive system 10 in accordance with the invention ensures smooth running and, thus, low-wear operation of the machine equipped with it—a result which is particularly advantageous under the aspect of high work cycle frequencies.

If, as explained in connection with FIG. 4, pre-setting of the feed and return strokes of the piston 26 is effected using a pulse-controlled electric stepping motor, the different feed and return strokes necessary for processing a workpiece can be readily programmed using the usual numerical-control techniques which enables the drive system 10 and/or a machine equipped therewith to be readily adapted to the most diverse operating conditions.

Figure 5:
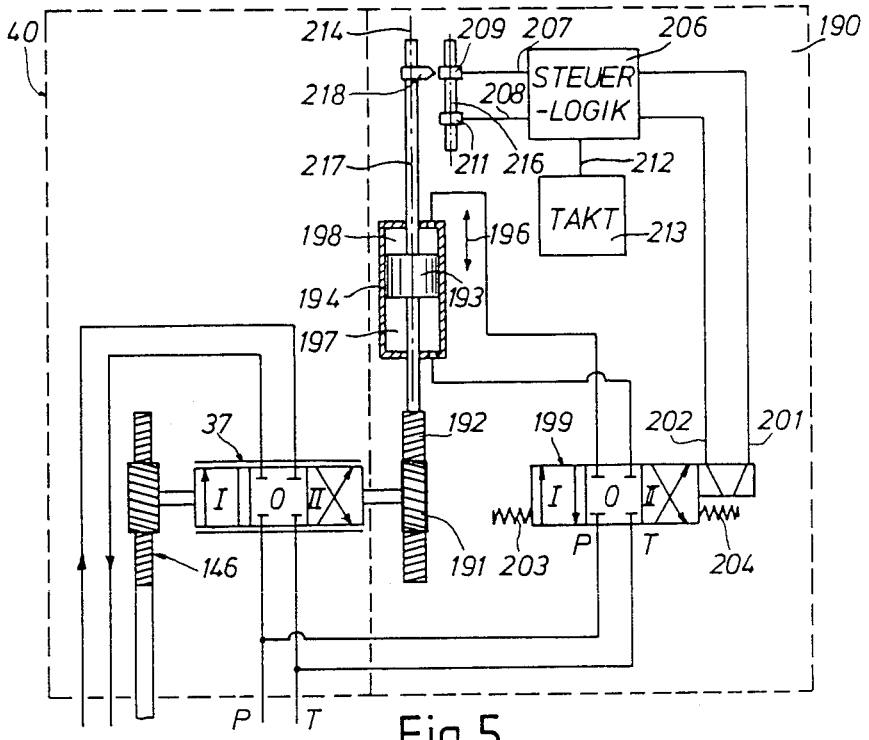
FIG. 5 is a schematic detail view of a simple pre-setting mechanism to be used in connection with the follow-up control valve shown in FIG. 4, as an alternative to the electrically controlled stepping motor.

In cases where the same work cycle is repeated a plurality of times in working a workpiece, i.e. where the tool 13 is constantly reciprocated between the same upper and lower end positions, which may be the case for instance in so-called nipple machines by which a workpiece with a given contour can be cut from a piece of sheet steel by punching out overlapping holes, the motion control of the hydraulic cylinder may also be realized by the control valve arrangement 40 generally shown in FIG. 5, which distinguishes itself from the one shown in FIG. 4 substantially in that pre-setting of the strokes of the hydraulic cylinder 14 is effected by a simple electro-hydraulic pre-setting device generally designated 190 in which the follow-up control valve employed as output stage has substantially the same design and function as that shown in FIG. 4. Pre-setting of the angular rotation of the spindle nut 166 in accordance with the set value is effected by a rack gear—generally designated 191—of a design analogous to that of the back-feeding device 146. The toothed rack 192 of the said rack gear is connected with the piston 193 of a double-acting control cylinder 194 for being alternatively driven by the latter in the directions indicated by the double arrow 196, in accordance with the alternative rotary pre-setting movements of the spindle nut 166.

The appropriate alternative application of pressures to the two working chambers 197 and 198 of the control cylinder 194 is regulated by a reversing valve 199 designed as 4/3 solenoid valve which assumes its operating position I when an electric high-level control signal is applied to its control input 201 and an electric low-level control signal is simultaneously applied to the second control input 202, and its operating position II when a low-level control signal is applied to its input 201 and high-level control signal to its control input 202. Otherwise, it is retained in its neutral closed position 0 by the biased pressure springs 203 and 204. In the operating position I of this 4/3 solenoid valve 199, the one pressure chamber 197 of the control cylinder 194 is connected to the high outlet pressure of the pressure source, while the other pressure chamber 198 communicates with the tank. In the operating position II of the said 4/3 solenoid valve 199, the pressure chamber 197 is connected with the tank, while the pressure chamber 198 of the control cylinder 194 is connected to the high-pressure side of the pressure source.

The control signal combinations required for triggering the 4/3 solenoid valve 199 in an appropriate manner are generated by an electronic control stage in the form of a logic circuit with a first and a second input 207 and 208 receiving the output signals of a first and a second position pickup 209 and 210, which may, for example take the form of approximation switches which generate output signal combinations characteristic of the end position of the feed motion and the end position of the return motion. A third input 212 of the said logic circuit receives the output signal of a pulse generator 213. The periodicity of the output signal corresponds to the sequence in time of the work cycles to be repeated and may, for instance, include a high-level voltage signal during the feed phase, and otherwise of a low-level voltage signal. The end position pickups 209 and 211 are slidably arranged on a guide element 216 extending in parallel to the longitudinal axis 214 of the control cylinder 194, and can be fixed in position. A piston rod 127 projecting from the housing of the control cylinder 194 carries on a portion extending in parallel to the said guide element 216 a triggering finger 218 which, each time it comes to lie opposite the one or the other end position pickup 209 or 211, triggers an electric output signal characteristic of this position, for instance a high-level voltage signal.

Without restricting the generality, it will be assumed hereafter, for illustration purposes, that the initial position of the piston 26 of the hydraulic cylinder 14 is associated with that position of the piston 193 of the control cylinder 194 in which the first position pickup 209 emits its high-level output signal, and that accordingly the end position of the feed motion of the piston 26 is associated with that position of the control piston 193 in which the second end position pickup 211 emits its high-level output signal. The end positions of the piston 26 of the hydraulic cylinder 14 can be pre-set by a convenient arrangement, and the distance between, the two end position pickups 209 and 211.

Figure 6:
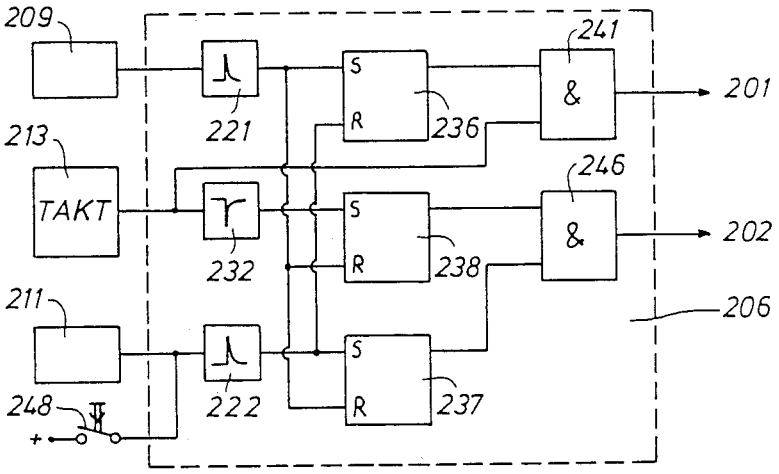
FIG. 6 is a block diagram of a control circuit suited for controlling a drive system equipped with the presetting mechanism of FIG. 5.

A control stage 206 which is suitable for use in connection with the pre-setting device 190 and which generates, by logic combination, the output signals suitable for controlling the 4/3 solenoid valve 199 from the output signals received from the end position pickups 209 and 211 and from the pulse generator 213, is shown in FIG. 6 and will be described hereafter in closer detail, with express reference to the said FIG. 6 and the pulse diagram shown in FIG. 7.

Figure 7:
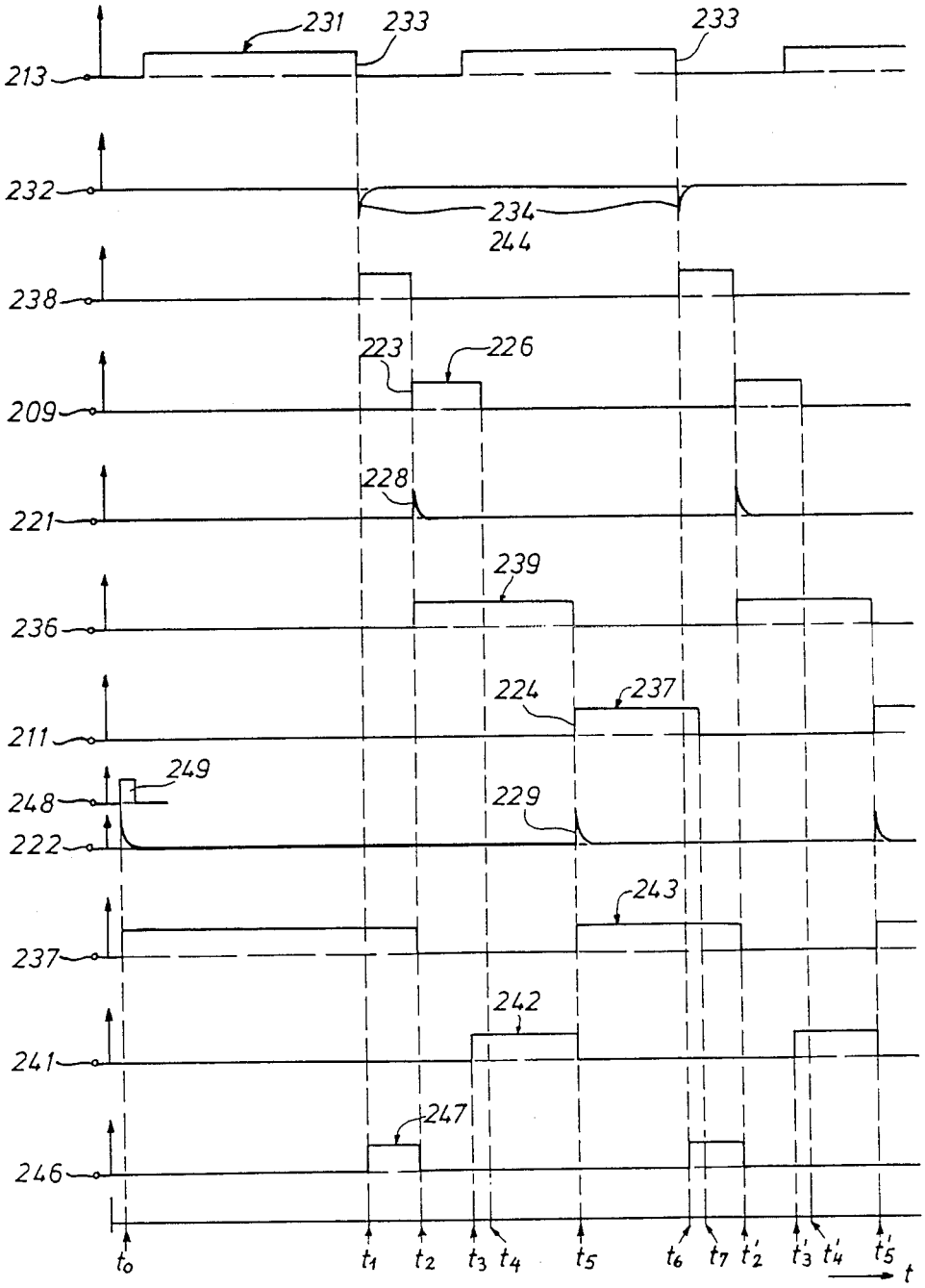
FIG. 7 is a pulse diagram illustrating the function of the control circuit of FIG. 6.

The output signals of the first and the second end position pickups 209 and/or 211 are applied to a first and/or a second differentiating circuit 221 and/or 222 which emit positive needle pulses 228 and/or 229 linked to the rising flancs 223 and 224 of the pickup pulses 226 and 227 (FIG. 7). The output pulses 231 of the pulse generator 213 whose high-level pulse width determines the duration of the feeding phase of the hydraulic cylinder 14, are applied to a third differentiating circuit 232 which emits negative needle pulses 234 linked with the dropping flancs 233 of the output pulses 231 of the pulse generator (FIG. 7). A first flipflop 236 can be set to high output signal level by the positive needle pulses 228 of the first differentiating circuit 221, and reset by the needle pulse output signals 229 of the second differentiating circuit 222. Further, a second flipflop 237 can be set to high output signal level by the same needle pulses 229 of the second differentiating circuit 222, and reset by the positive output needle pulses 228 of the first differentiating circuit 221. A third flipflop 238 can be set to high output signal level by the negative needle output pulses 234 of the third differentiating circuit 232, and likewise reset by the output needle pulses 228 of the first differentiating circuit 221. The output pulses 239 (FIG. 7) of the first flipflop and the output pulses 231 of the pulse generator 213 are applied to a first AND gate 241 with two inputs. The output signals 242 (FIG. 7) of the said AND gate are applied to the first control input 201 of the 4/3 solenoid valve 199. The output pulses 243 of the second flipflop 237 and the output pulses of the third flipflop 238 are applied as input signals to a third AND gate with two inputs, the output signals 247 of which are applied to the second control input 204 of the 4/3 solenoid valve 199.

The function of the before-described logic control stage 206 within the pre-setting device 190 is as follows.

The appearance of a starting pulse 249, which may be released for instance by means of a hand key 248, causes the second differentiating circuit 222 to generate at the moment $t_0$ a first needle pulse 229 for setting the second flipflop 237. The outputs of the two AND gates 241 and 246 are at low signal level. The pulse generator 213 has been activated when the system was switched on, and when its output signal drops at the moment $t_1$, the third flipflop 238 is set, and a first control signals 247 appears at the output of the second AND gate 246 which causes the 4/3 solenoid valve 199 to assume its operating position I. The piston 193 of the control cylinder 194 starts to move towards its upper end position, as viewed in FIG. 5—which corresponds also to the initial position of the hydraulic cylinder 14 for each work cycle. When the piston reaches the said end position at the moment $t_2$, the high-level output signal 226 is emitted by the first end position pickup 209 to set the first flipflop 236 and reset the second flipflop 237, whereupon, the control output signal of the second AND gate drops and the 4/3 solenoid valve 199 returns to its closed position. The piston 193 remains in its upper end position until upon occurrence of the next output pulse 231 emitted by the pulse generator at the moment $t_3$ the first AND gate 241 emits its high-level output signal to cause the 4/3 solenoid valve 199 to return to its operating position I. This initiates the downward movement of the control piston 193 by which the feed motion of the piston 26 of the hydraulic cylinder 14 is preset. The output signals 226 of the first end position pickup 209 drops immediately after commencement of the said downward movement at the moment $t_4$. When the triggering finger 218 comes to lie opposite the second end position pickup 211 at the moment $t_5$, the latter's end position signal 227 is triggered to reset the first flipflop 236 and set the flipflop 237. The output signal of the first AND gate 241 drops, so that the 4/3 solenoid valve 199 returns to its closed position 0 and the piston 193 of the control cylinder 194 stops in its lower end position. When the output signal of the pulse generator drops at the moment $t_6$, the third flipflop 238 is set again, and the second AND gate 246 emits another high-level output signal 247 associated with another upward movement of the piston 193 of the control cylinder 194. Immediately thereafter, the output signal 227 of the second end position pickup 211 drops at the moment $t_7$. The upward movement of the piston 193 continues until at the moment $t_2$ the first end position pickup 209 responds to start repeating of the work cycle described before at the period of the signal emitted by the pulse generator.

Figure 8:
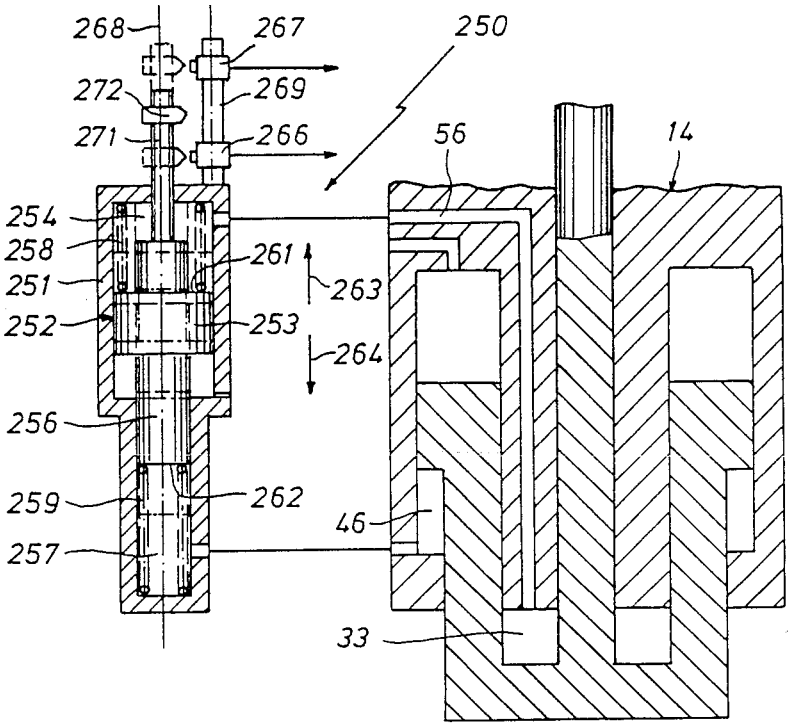
FIG. 8 is a cross-sectional detail view of an electro-hydraulic monitoring system suited for monitoring the function of the hydraulic cylinder of the drive system shown in FIGS. 1 to 3.

Finally, a device 250 suited for monitoring the function of the hydraulic cylinder for use within the drive system 10 will be described with reference to FIG. 8. In the particular embodiment shown in the drawing, this device 250 responds to the pressures prevailing in the first pressure chamber 33 and in the second pressure chamber 46 of the hydraulic cylinder 14, or to the forces acting on the first working surface 66 and the second working surface 46 of the piston 26 of the hydraulic cylinder 14 during the feed and return phases.

The device 250 comprises a stepped piston generally designated 252 mounted for axial displacement in a cylinder housing 251. The larger step 253 of the said piston defines a secondary pressure chamber communicating with the first pressure chamber 33 of the hydraulic cylinder 14, while the smaller step 256 defines a second secondary pressure chamber 256 sommunicating with the second pressure chamber 46 of the hydraulic cylinder 14. When the same pressure prevails in the two pressure chambers 33 and 46 of the hydraulic cylinder 14 and, thus, in the two secondary pressure chambers 254 and 256 of the device 250, the stepped piston 252 is held in its equilibrium position, shown in full lines, by the restoring forces of a first and a second pressure spring 258 and 259 which, without limiting the generality, are assumed for our purpose to have identical force constants. It is further assumed that the design of the device is such that the surface ratio a1/a2 of the active piston surfaces 261 and 262 of the larger and the smaller steps 253 and 256 of the stepped piston 252 corresponds with the surface A1/A2 of the piston and housing surfaces 66 and 43, and 32 and 44 which define the second pressure chamber 46 of the hydraulic drive cylinder 14.

When the monitoring device 250 is designed in this manner, the displacement of the stepped piston 252 in the direction indicated by the arrows 263 or 264 relative to its equilibrium position is a measure for the forces acting upon the piston 26 of the hydraulic cylinder 14 in the feed or return directions so that the monitoring device 250 may insofar be used for controlling the feed and return movements of the hydraulic drive cylinder 14 in response to the prevailing pressures.

In the embodiment shown in the drawing, the monitoring device 250 generates a first output signal when the force acting in the feed direction of the hydraulic cylinder 14, registered by the pressure prevailing in the first pressure chamber 33, reaches or exceeds a predetermined minimum value, and a second output signal when the force acting upon the piston 26 during a return movement reaches or exceeds a given threshold value. This special function of the monitoring device 250 is realized with the aid of a first end position pickup 266 and a second end position pickup 267 which are slidably guided on a guide element 269 extending at a lateral distance and in parallel to the longitudinal axis 268 of the housing, viewed in the direction of the said axis, and which can be fixed on the said guide element at a defined axial distance from each other. A piston rod 271 projecting from one side of the housing 251 in dust-tight elationship carries a triggering finger 272 which can likewise be displaced along, and fixed in position of the stepped piston 252 occupies a central position between the two end position pickups 266 and 267. The stepped piston 252 assumes the lower end position, as shown in FIG. 8—when the pressure in the first secondary pressure chamber 254 of the monitoring device 250, which corresponds to the pressure in the first pressure chamber 33 of the hydraulic cylinder 14, reaches or exceeds the before-mentioned defined threshold value. In this position, the triggering finger 272 occupies a position opposite the first end position pickup 266 so that the latter emits a high-level voltage signal. The second end position, the other position in FIG. 8 is assumed by the stepped piston 252 as soon as the pressure in the second pressure chamber 46 of the hydraulic cylinder 14 exceeds a defined threshold value. In this position, the triggering finger 272 occupies a position opposite the second end position pickup 267 so that the latter also emits a high-level voltage signal, whereas otherwise it emits a low-level voltage signal.

Since the pressure regulation provided by the follow-up control valve 37 through which the pressure is alternatively applied to the first and the second pressure chambers 33 and 46 of the hydraulic cylinder 14, in accordance with the different directions of movement 264 and 263, is always adapted to the pressure requirements, which means that for instance in the case of a punching process the working pressure is increased when the resistance against which the piston 26 is to be moved is high or increases, the high-level output signals of the end position pickups 266 and 267 are a reliable indication of such operating conditions. If in the example just mentioned the high-level output signals would continue for a period longer than that characteristic of a normal punching process, this would for instance indicate that the tool 13 has become blunt and should be changed. If, the output signal of the first end position pickup 266 drops, this reliably signals that the tool 13 has completed its working stroke so that pre-setting of the return movement of the piston 26 can be immediately initiated, which may be an advantage if short cycle times are desired. Analogously, if the output signal of the second end position pickup 267 continues, this indicates in the selected example that the piston 26 of the hydraulic cylinder 14 cannot have completed its return movement yet, and if this signal continues for a period longer than would be expected as being normal, it may be used for instance for releasing an alarm or for switching off the drive system 10 as a safety measure.

It goes without saying that instead of limiting the monitoring function to the maximum values of the forces acting upon the piton 26, the forces could also be continuously monitored by the device 250. This could be achieved, for example, by a linear pickup coupled via the piston rod 271 of the stepped piston 252 for generating an output signal proportional to the displacement of the stepped piston 252 in the one direction 264 or the other direction 263.

I claim:

1. A hydraulic driving arrangement for a machine element processing a workpiece and performing an operating cycle composed of a rapid feed motion directed towards the workpiece, followed by a working stroke effected in the same direction and serving to process the workpiece, and finally an oppositely directed rapid return motion, with a hydraulic cylinder serving as driving element and comprising at least three working services respectively defining each delimiting a face of a first, a second and a third pressure chamber, a rapid feed motion and a rapid return motion of the piston of the hydraulic cylinder for the machine element being controllable by an alternate admission and release of pressure to and from the first and the second pressure chambers of the hydraulic cylinder, while a feeding power can be increased, if necessary to perform the working stroke, by admitting pressure to the third pressure chamber of the hydraulic cylinder delimited by the said third working surface, characterized in that for motion control of the machine element with respect to direction and lift a hydraulic control circuit is provided, the hydraulic control circuit comprising a hydromechanical actual-value feed-back device adapted to be supplied with pre-setting signals characteristic of at least end positions of the machine element for presetting the desired values, said hydraulic control circuit effecting both an alternative supply of pressure to the first and the second pressure chambers and, if necessary, the supply of pressure to the third pressure chamber; that for changing over the hydraulic cylinder from rapid-feed motion to the working stroke a reversing valve with hydraulic pilot valve is provided which, in a first flow position corresponding to the rapid-feed motions, connects the third pressure chamber of the hydraulic cylinder with a tank of a pressure supply source, and, in a second flow position connects the same pressure chamber with the a pressure outlet of a final control element of the control circuit; and that, for controlling the reversing valve, a pilot control valve arrangement is provided which responds to a output pressure $P_A$ of the hydraulic control circuit and which moves the reversing valve into a second flow position when said output pressure $P_A$ exceeds a pre-determined threshold $P_{s1}$, and returns the reversing valve into a first flow position when the output pressure $P_A$ of the control circuit has dropped to a value $P_{s2}$ corresponding maximally to a value $P_{s1}$. $A1/A_L$, wherein: $A_1$ is a size of a surface of a piston upon which the output pressure $P_A$ of the hydraulic control circuit acts during rapid-feed motion of the hydraulic cylinder and $A_L$ is a size of an overall surface of a piston upon which the controller output pressure $P_A$ acts during the working stroke of the hydraulic cylinder.

2. A hydraulic drive system in accordance with claim 1, characterized in that the lower pressure threshold value $P_{s1}$ at which the pilot control valve arrangement moves into the first operating position corresponding to the first flow position of the reversing valve is defined by the formula:

$$P_{s2}=P_{s1}\,(A_1/A_L)\text{-}q)$$

wherein:

$0.95>q>0.8$.

3. A hydraulic drive system in accordance to one of claims 1 or claim 2, characterized in that an output stage of the pilot control valve arrangement is formed by a 3/2 directional valve constructed as pressure-controlled sliding valve with a first and a second control pressure chamber, that when the pressure level in the two control pressure chambers is substantially equal, a piston of the 3/2 directional valve is held by a bias of a restoring spring in its first operating position corresponding to a neutral position, in which a high-level pressure signal is applied to its output which retains the reversing valve in a first flow position corresponding to the rapid-free motions of the hydraulic cylinder, while when the pressure prevailing in the first control pressure chamber is higher than that prevailing in the second pressure chamber it is moved into a second operating position in which the control pressure chamber of the reversing valve is pressure-relieved or connected with the tank so that the reversing valve is moved into a flow position associated with the working stroke; that the first control pressure chamber of the 3/2 directional valve is directly connected with the pressure outlet of the control circuit and the second control pressure chamber of the 3/2 directional valve is connected with the pressure outlet of the control circuit via a flow resistance; and that an over-center device responding to the output pressure $P_A$ of the control circuit and constructed as a proportioning pressure regulator is provided which when the output pressure $P_A$ exceeds the first threshold value $P_{s1}$ connects the second control pressure chamber of the valve with the tank and, when the output pressure $P_A$ of the control circuit drops below a lower pressure threshold value Ps2, cuts off this connection between the control pressure chamber and the tank of the supply pressure source.

4. A hydraulic drive system in accordance with claim 3, characterized in that the over-center device comprises a control pressure chamber directly connected to the pressure output of the hydraulic control circuit, which control pressure chamber is delimited against an output pressure chamber communicating with the second control pressure chamber of the 3/2 directional valve, by a free piston mounted to reciprocate in the direction of a longitudinal axis of a housing of the over-center device, which output pressure chamber is in turn shut off against the tank of the supply pressure source when a seat valve with a spring-loaded valve body is in a neutral closed position, and connected to communicate with the tank of the pressure supply source when said seat valve is in an open position; and that a surface ratio of a cross-sectional surface of the output pressure chamber enclosed by the valve seat, to an effective surface of a free piston coupled via a spacer to the spring-loaded valve body to move with the latter, corresponds to the ratio $P_{s2}/P_{s1}$ of the pressure threshold values $P_{s1}$ and $P_{s2}$ governing a reversal from rapid feed to working stroke and/or from working stroke to rapid feed.

5. A hydraulic drive system in accordance with claim 4, characterized in that a bias of a pressure spring provided for urging the spring-loaded valve body of the valve seat into the closed position is adjustable.

6. A hydraulic drive system in accordance with claim 5, characterized in that the seat valve includes as ball valve having a ball of a diameter smaller than a diameter of a housing bore in which the ball is arranged to move in an axial direction, and that a pressure piston is slidably guided in the housing and urged against said ball by a pressure spring bearing against said ball by a conical centering face.

7. A hydraulic drive system in accordance to claim 1, characterized in that the reversing valve includes a 3/2 directional sliding valve which is shifted into a first flow position by a high-level output pressure of the pilot control valve against a restoring force of a pressure spring, and moved into a second flow position by a restoring force of a pressure spring at a low output pressure level, an output pressure chamber of the reversing valve, which remains the same in all operating positions of the latter and which communicates via a flow path of the low flow resistance with the third pressure chamber of of the hydraulic cylinder, is in the first flow position of said reversing valve connected with the tank of the pressure supply source via va flow path of likewise low flow resistance, and, in the second flow position of the reversing valve, in which the first-mentioned flow path is blocked by the fact that a sealing edge of the valve body bears against a conical valve seat of a valve housing, is connected with the pressure outlet of the hydraulic control circuit by a control channel in a valve housing which is opened in this position of the valve body.

8. A hydraulic drive system in accordance with claim 7, characterized in that the valve housing of the reversing includes a valve bore constructed as stepped bore having a narrower step communicating within the conical valve seat with the third pressure chamber of the hydraulic cylinder and a larger bore step comprising a control channel communicating with the pressure outlet of the control hydraulic control circuit; that the valve body of the reversing valve is constructed as a substantially tubular body slidable guided, in pressure-tight relationship, in said valve bore by contact of an outer surface thereof with a wall of the narrower step of the bore and contact of an outwardly projecting flange with the wall of the larger step of the valve bore, said flange and s annular face between the two bore steps delimiting the control pressure chamber of the reversing valve in an axial direction, and that flange acting to shut off the control channel against the output pressure chamber in the first flow position of the reversing valve and to open the connection between the control channel and the output pressure chamber of the reversing valve in the second flow position.

9. A hydraulic drive system in accordance with claim 8, characterized in that a large-volume annular space forming part of the tank of the pressure supply source is arranged in a housing of the reversing valve in a coaxial arrangement with the valve bore, which annular space can be connected with the output pressure chamber of the reversing valve through large, radially extending overflow channels which open into the narrower bore step and which are opened in the first flow position of the reversing valve and closed in its second flow position by the valve body.

10. A hydraulic drive system according to claim 9, characterized in that the reversing valve forms an axial extension of the hydraulic cylinder, a housing of the hydraulic cylinder and valve housing of the reversing valve forming one single constructional unit.

11. A hydraulic drive system according to claim 1, characterized in that a output stage of the hydraulic control circuit includes a mechano-hydraulic follow-up control valve including a 4/3 directional valve with a pre-setting arrangement in including a spindle drive and an actualvalue back-feeding device, with pre-setting being effected by rotary movement of a spindle nut by rotary angles $\phi_V$ and $\phi_R$ correlated, with respect to amount and direction, with feed and return travels of a piston of the hydraulic cylinder, and back-feed of different actual piston positions being effected by a mechanical back-feeding device which causes a spindle of the spindle drive to perform rotary movements correlated, with respect to amount and direction, with the feed and return movements of the piston of the hydraulic cylinder.

12. A hydraulic drive system in accordance with claim 11, characterized in that for presetting the feed and return motions of the piston of the hydraulic cylinder a stepping motor capable of being controlled in start-stop operation is provided which can operate at a control pulse frequency being to one-hundred times greater than a number of stepping control pulses required within a period of time of a work cycle for achieving a sufficiently exact motion control.

13. A hydraulic drive system in accordance with claim 11, characterized in that an electro-hydraulic pre-setting mechanism is provided within the hydraulic control circuit for a motion control of the piston of the hydraulic cylinder, which electro-hydraulic presetting mechanism effecting pre-setting of the desired end-position values determining the feed and return motions of the piston of the hydraulic cylinder by causing a double-acting control cylinder in a cycle-related manner to move its piston into alternative end positions associated with defined rotary positions of the spindle nut of the follow-up control valve.

14. A hydraulic drive system in accordance with claim 13, characterized in that for controlling the control cylinder of the pre-setting mechanism a 4/3 directional solenoid valve with two control windings is provided, that in a nonexcited condition of the said windings the 4/3 directional solenoid value valve assumes a neutral blocked (zero) position associated with a neutral position of the piston of the control cylinder, while by alternatively exciting said windings by a control current the valve can be moved against the restoring force of pressure springs to its alternative flow positions, in which the piston (193) of the control cylinder moves into its alternative end positions; and that a control stage is provided which responds to the output signals of end-position pickups generating output signals characteristic of one or the other end positions of the control piston and to output pulses of a pulse generator provided for controlling the cycle, and which generates necessary control current pulses for controlling the 4/3 directional solenoid valve in an appropriate manner, by logic combination of said input signals.

15. A hydraulic drive system in accordance with claim 14, characterized in that end position pickups, including at least two approximation switches which, when occupying a position opposite a triggering finger which follows movements of the piston of the control cylinder, generate output signals characteristic of a given position, for instance a high-level voltage signal, said end position pickups being slidably mounted on a guide element extending in parallel to a direction of movement of the triggering finger, and arranged to be fixed at a selective distance from each other corresponding to the end positions of the piston, and that the triggering finger is mounted, if necessary for being displaceable, on a piston rod projecting from a housing of the control cylinder, and for being fixed thereon.

16. A hydraulic drive system in accordance with claim 15, characterized in that output signals characteristic of actual positions emitted by the end position pickups are high-level voltage signals in the end positions of the control piston and output pulses of the pulse generator are also high-level voltage signals for a duration of successive feed and return motions of the cylinder, while for the rest of the time the same signals are low-level voltage signals, that the control stage comprises a first storage circuit that can be set to high output signals level by rising flanks of the output signals of the first end position pickup, and reset by the rising flanks of output pulses of the second end position pickup, and a second storage circuit that can be set to high output signals level by the rising flanks of the output pulses of the second end position pickup and reset by the rising of the output pulses of the first end position pickup, and further a third storage circuit that can be set to high output signals level by dropping flanks of output pulses emitted by the pulse generator and reset by the rising flanks of output pulses of the first end position pickup and that a first AND gate with two inputs is provided to which output signals of the first storage circuit and output pulses of the pulse generator are applied as input pulses, and a second AND gate with two inputs is provided to which the output pulses of the second and the third storage circuits are applied as input signals; and that the output pulses of the two AND gates with two inputs can release the current control signals for controlling the 4/3 directional solenoid valve.

17. A hydraulic drive system in accordance with claim 1, characterized in that a monitoring device is provided which responds to pressure in the first or the third pressure chamber and to pressure in the second pressure chamber of the hydraulic cylinder, and which generates a characteristic output signal as long as forces acting in the feed or return directions of a piston of the hydraulic cylinder are greater than certain predetermined threshold values.

18. A hydraulic drive system in accordance with claim 17, characterized in that the monitoring device comprises at least one double-acting hydraulic cylinder having a piston defining a secondary pressure chamber which communicates with the first or the second pressure chambers of the hydraulic drive cylinder against a second secondary pressure chamber which communicates with the second pressure chamber of the hydraulic drive cylinder, the piston including a stepped piston having piston surfaces of larger and smaller piston steps, which correspond to cross-sectional surfaces of the secondary pressure chambers exhibit the same ratio as effective cross-sectional surfaces of the connected pressure chambers of the hydraulic cylinder, and that the piston can be displaced, against an increasing restoring force, from an equilibrium position defined by a position between possible end positions.

19. A hydraulic drive system in accordance with claim 18, characterized in that the piston surfaces of the stepped piston defining the secondary pressure chambers of the hydraulic cylinder of the monitoring device are much smaller than the effective piston surfaces of the piston of the hydraulic drive cylinder which define one side of the pressure chambers communicating with the secondary pressure chambers of the hydraulic cylinder of the monitoring device.

20. A hydraulic drive system in accordance with claim 19, characterized in that a surface ratio of the surfaces of the stepped piston (252) defining the secondary pressure chambers of the hydraulic cylinder of the monitoring device, to surfaces of the piston of the hydraulic drive cylinder delimiting the pressure chambers of the hydraulic drive cylinder communicating with the secondary pressure chambers is between 1/1000 and 1/2000.

21. A hydraulic drive system in accordance with claim 20, characterized in that at least two end-position pickups coact with the double-acting hydraulic cylinder, the first of said end position pickups generating a characteristic output signal when the stepped piston is in one end position which is associated with an excessive pressure $P > P_{s1}$ in the first secondary pressure chamber of the hydraulic cylinder of the monitoring device, and the second end position pickup generating a characteristic output signals when the stepped piston is in its other end position associated with excessive pressure in the second secondary control chamber of the hydraulic cylinder of the monitoring device.

22. A hydraulic drive system according to claim 21, characterized in that a first monitoring device is provided whose first secondary pressure chamber communicates with the first pressure chamber of the hydraulic drive cylinder, and a secondary monitoring system whose first secondary pressure chamber communicates with the third pressure chamber of the hydraulic drive cylinder while the second secondary pressure chambers of the monitoring devices communicate with the second pressure chamber of the hydraulic drive cylinder.

23. A hydraulic drive system according to claim 1 in, punching or nipple machines for rapid succession of work cycles and performance of 300 to 600 work cycles per minute.

24. A hydraulic drive system according to claim 1, in presses or stamping machines.

25. A hydraulic drive system in accordance with claim 20, characterized in that the surfaces ratio of the surfaces is 1/000.

* * * * *